US007914100B2

(12) United States Patent
Kashimoto et al.

(10) Patent No.: US 7,914,100 B2
(45) Date of Patent: Mar. 29, 2011

(54) RECORDING APPARATUS AND TRANSPORT AMOUNT CORRECTING METHOD

(75) Inventors: Yusuke Kashimoto, Shiojiri (JP); Tatsuya Nakano, Hata-machi (JP); Masahiko Yoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 12/315,784

(22) Filed: Dec. 5, 2008

(65) Prior Publication Data

US 2009/0167806 A1 Jul. 2, 2009

(30) Foreign Application Priority Data

Dec. 5, 2007 (JP) ..... 2007-315248

(51) Int. Cl.
*B41J 29/38* (2006.01)
*B65H 7/02* (2006.01)

(52) U.S. Cl. ..... 347/16; 271/265.01

(58) Field of Classification Search ..... 347/16; 271/265.01

See application file for complete search history.

(56) References Cited

U.S. PATENT DOCUMENTS

| | | | | |
|---|---|---|---|---|
| 6,101,426 | A * | 8/2000 | Kimura et al. | 271/265.01 |
| 6,851,802 | B2 * | 2/2005 | Sakakibara et al. | 347/108 |
| 7,480,081 | B2 * | 1/2009 | Otsuki | 358/3.28 |
| 2004/0061767 | A1 * | 4/2004 | Yamada | 347/215 |
| 2008/0007586 | A1 * | 1/2008 | Yoshida et al. | 347/16 |
| 2008/0106031 | A1 * | 5/2008 | Nakano et al. | 271/265.01 |
| 2008/0192270 | A1 * | 8/2008 | Nakano et al. | 358/1.9 |

FOREIGN PATENT DOCUMENTS

| | | |
|---|---|---|
| JP | 05-096796 | 4/1993 |
| JP | 2001-001584 | 1/2001 |
| JP | 2002-254736 | 9/2002 |
| JP | 2003-011345 | 1/2003 |
| JP | 2004-175092 | 6/2004 |
| JP | 2007-055095 | 3/2007 |
| JP | 2007-083500 | 4/2007 |
| JP | 2008049610 A * | 3/2008 |

OTHER PUBLICATIONS

English translation of specification of patent document JP2008-049610A to Nakano et al., acquired Mar. 8, 2010 via http://www.ipdl.inpit.go.jp/homepg_e.ipdl.*

* cited by examiner

*Primary Examiner* — Matthew Luu
*Assistant Examiner* — Shelby Fidler
(74) *Attorney, Agent, or Firm* — Nutter McClennen & Fish LLP; John J. Penny, Jr.; Christina M. Sperry

(57) ABSTRACT

A recording apparatus including: a head for performing recording on a medium, a transport mechanism that includes a roller on an upstream side of the head and transports the medium in the transport direction according to a target transport amount that is targeted, a sensor that is provided at a more upstream side than the upstream-side roller in order to detect a lower end of the medium transported in the transport direction, and a controller that corrects the target transport amount by correction values matched with a relative position of the head and the medium.

4 Claims, 30 Drawing Sheets

FIG. 22
| CORRECTION VALUE | BOUNDARY POSITION INFORMATION |
|---|---|
| Ca(1) | THEORETICAL POSITION CORRESPONDING TO L2 |
| Ca(2) | THEORETICAL POSITION CORRESPONDING TO L3 |
| Ca(3) | THEORETICAL POSITION CORRESPONDING TO L4 |
| ⋮ | ⋮ |
| Ca(20) | THEORETICAL POSITION CORRESPONDING TO L21 |
| Ca(21) | THEORETICAL POSITION CORRESPONDING TO L22 |
FIG. 23A
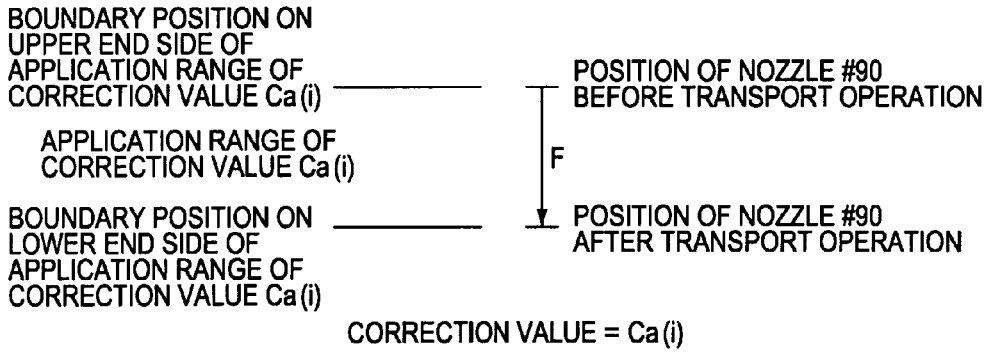
FIG. 23B
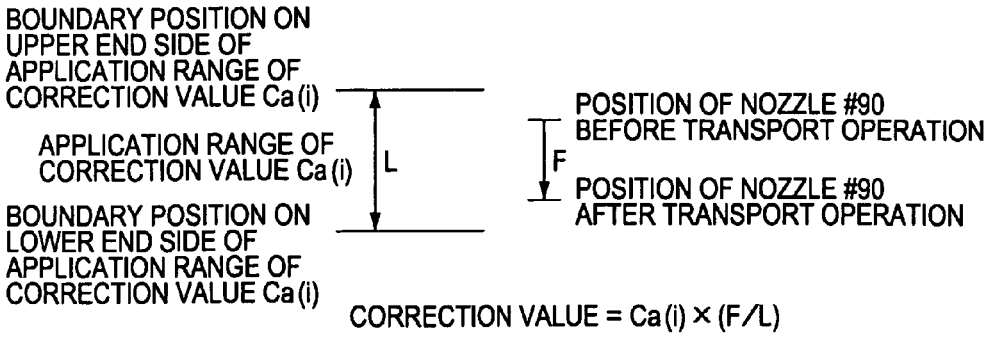

CORRECTION VALUE = Ca(i) × (F1/L) + Ca(i+1) × (F2/L)

CORRECTION VALUE = Ca(i) × (F1/L) + Ca(i+1) + Ca(i+2) × (F2/L)

FIG. 29

| CORRECTION VALUE | BOUNDARY POSITION INFORMATION |
|---|---|
| Ca (1) | THEORETICAL POSITION CORRESPONDING TO L2 |
| Ca (2) | THEORETICAL POSITION CORRESPONDING TO L3 |
| Ca (3) | THEORETICAL POSITION CORRESPONDING TO L4 |
| Ca (4) | THEORETICAL POSITION CORRESPONDING TO L5 |
| Ca (5) | THEORETICAL POSITION CORRESPONDING TO L6 |
| Ca (6) | THEORETICAL POSITION CORRESPONDING TO L7 |
| Ca (7) | THEORETICAL POSITION CORRESPONDING TO L8 |
| Ca (8) | THEORETICAL POSITION CORRESPONDING TO L9 |
| Ca (9) | THEORETICAL POSITION CORRESPONDING TO L10 |
| Ca (10) | THEORETICAL POSITION CORRESPONDING TO L11 |
| Ca (11) | THEORETICAL POSITION CORRESPONDING TO L12 |
| Ca (12) | THEORETICAL POSITION CORRESPONDING TO L13 |
| Ca (13) | THEORETICAL POSITION CORRESPONDING TO L14 |
| Ca (14) | THEORETICAL POSITION CORRESPONDING TO L15 |
| Ca (15) | THEORETICAL POSITION CORRESPONDING TO L16 |
| Ca (16) | THEORETICAL POSITION CORRESPONDING TO L17 |
| Ca (17) | THEORETICAL POSITION CORRESPONDING TO L18 |
| Ca (18) | THEORETICAL POSITION CORRESPONDING TO L19 |
| Ca (19) | THEORETICAL POSITION CORRESPONDING TO L20 |
| Ca (20) | THEORETICAL POSITION CORRESPONDING TO L21 |
| Ca (21) | THEORETICAL POSITION CORRESPONDING TO L22 |

RELATIVE POSITION AT WHICH LOWER END IS TO BE DETECTED

TRANSPORT RANGE IN WHICH CORRECTION VALUE WITH LOWER END AS REFERENCE IS APPLIED

RELATIVE POSITION WHEN DEVIATING FROM TRANSPORT ROLLER

FIG. 31

| CORRECTION VALUE | BOUNDARY POSITION INFORMATION |
|---|---|
| Ca (1) | THEORETICAL POSITION CORRESPONDING TO L2 |
| Ca (2) | THEORETICAL POSITION CORRESPONDING TO L3 |
| Ca (3) | THEORETICAL POSITION CORRESPONDING TO L4 |
| Ca (4) | THEORETICAL POSITION CORRESPONDING TO L5 |
| Ca (5) | THEORETICAL POSITION CORRESPONDING TO L6 |
| Ca (6) | THEORETICAL POSITION CORRESPONDING TO L7 |
| Ca (7) | THEORETICAL POSITION CORRESPONDING TO L8 |
| Ca (8) | THEORETICAL POSITION CORRESPONDING TO L9 |
| Ca (9) | THEORETICAL POSITION CORRESPONDING TO L10 |
| Ca (10) | THEORETICAL POSITION CORRESPONDING TO L11 |
| Ca (11) | THEORETICAL POSITION CORRESPONDING TO L12 |
| Ca (12) | THEORETICAL POSITION CORRESPONDING TO L13 |
| Ca (13) | THEORETICAL POSITION CORRESPONDING TO L14 |
| Ca (16) | THEORETICAL POSITION CORRESPONDING TO L15 |
| Ca (17) | THEORETICAL POSITION CORRESPONDING TO L16 |
| Ca (18) | THEORETICAL POSITION CORRESPONDING TO L17 |
| Ca (19) | THEORETICAL POSITION CORRESPONDING TO L18 |
| Ca (20) | THEORETICAL POSITION CORRESPONDING TO L19 |
| Ca (21) | THEORETICAL POSITION CORRESPONDING TO L20 |

RELATIVE POSITION AT WHICH LOWER END HAS BEEN DETECTED

TRANSPORT RANGE IN WHICH CORRECTION VALUE WITH LOWER END AS REFERENCE IS APPLIED

RELATIVE POSITION WHEN DEVIATING FROM TRANSPORT ROLLER

FIG. 32

| CORRECTION VALUE | BOUNDARY POSITION INFORMATION |
|---|---|
| Ca (1) | THEORETICAL POSITION CORRESPONDING TO L2 |
| Ca (2) | THEORETICAL POSITION CORRESPONDING TO L3 |
| Ca (3) | THEORETICAL POSITION CORRESPONDING TO L4 |
| Ca (4) | THEORETICAL POSITION CORRESPONDING TO L5 |
| Ca (5) | THEORETICAL POSITION CORRESPONDING TO L6 |
| Ca (6) | THEORETICAL POSITION CORRESPONDING TO L7 |
| Ca (7) | THEORETICAL POSITION CORRESPONDING TO L8 |
| Ca (8) | THEORETICAL POSITION CORRESPONDING TO L9 |
| Ca (9) | THEORETICAL POSITION CORRESPONDING TO L10 |
| Ca (10) | THEORETICAL POSITION CORRESPONDING TO L11 |
| Ca (11) | THEORETICAL POSITION CORRESPONDING TO L12 |
| Ca (12) | THEORETICAL POSITION CORRESPONDING TO L13 |
| Ca (13) | THEORETICAL POSITION CORRESPONDING TO L14 |
| Ca (14) | THEORETICAL POSITION CORRESPONDING TO L15 |
| Ca (15) | THEORETICAL POSITION CORRESPONDING TO L16 |
| Ca (15) | THEORETICAL POSITION CORRESPONDING TO L17 |
| Ca (15) | THEORETICAL POSITION CORRESPONDING TO L18 |
| Ca (16) | THEORETICAL POSITION CORRESPONDING TO L19 |
| Ca (17) | THEORETICAL POSITION CORRESPONDING TO L20 |
| Ca (18) | THEORETICAL POSITION CORRESPONDING TO L21 |
| Ca (19) | THEORETICAL POSITION CORRESPONDING TO L22 |
| Ca (20) | THEORETICAL POSITION CORRESPONDING TO L23 |
| Ca (21) | THEORETICAL POSITION CORRESPONDING TO L24 |

RELATIVE POSITION AT WHICH LOWER END HAS BEEN DETECTED

TRANSPORT RANGE IN WHICH CORRECTION VALUE WITH LOWER END AS REFERENCE IS APPLIED

RELATIVE POSITION WHEN DEVIATING FROM TRANSPORT ROLLER

RECORDING APPARATUS AND TRANSPORT AMOUNT CORRECTING METHOD

BACKGROUND OF THE INVENTION

1. Field of the Invention

The present invention relates to a recording apparatus and a transport amount correcting method. In particular, the invention relates to a recording apparatus, which transports a medium by correcting the transport amount while modifying the relative position of a correction value applied for transport of the medium, and a transport amount correcting method.

2. Invention of the Related Art

There is a printer that performs printing by discharging ink droplets while transporting paper that is a medium. In such a printer, high paper transport accuracy is required to improve the quality of an image. A technique of correcting a paper feed error is disclosed in Patent Document 1. In addition, Patent Document 2 discloses correcting the transport amount by application of a correction value corresponding to each line.

[Patent Document 1] JP-A-2003-11345

[Patent Document 2] JP-A-5-96796

Highly accurate transport may be performed by application of a correction value corresponding to every relative position of a transported medium with respect to a printer. At this time, a correction value for correcting the transport amount is prepared in accordance with each relative position of paper in the transport direction, and correction of the transport amount is appropriately performed by application of each correction value at the corresponding relative position.

However, the relative position of the medium at which application of each correction value is expected may be changed in actual transport. In such a case, since the relative position of an applied correction value with respect to the medium does not match, the transport amount cannot be corrected suitably. Accordingly, the relative position of a correction value applied for transport of the medium needs to be modified in the transport process.

SUMMARY OF THE INVENTION

The present invention has been made in view of such a situation, and it is an object of the present invention to transport a medium by correcting the transport amount while modifying the relative position of a correction value applied for transport of the medium.

The main invention for achieving the above object is a recording apparatus including: (A) a head for performing recording on a medium, (B) a transport mechanism that includes a roller on an upstream side of the head and transports the medium in the transport direction according to a target transport amount that is targeted, (C) a memory that stores a plurality of correction values which are correction values for correcting the target transport amount when transporting the medium and which are matched with a relative position of the head and the medium, (D) a sensor that is provided at a more upstream side than the upstream-side roller in order to detect a lower end of the medium transported in the transport direction, and (E) a controller that corrects the target transport amount by a correction value, which is matched with the relative position with an upper end of the medium as a reference, and makes the transport mechanism transport the medium by the corrected target transport amount and that corrects the target transport amount by a correction value, which is matched with the relative position with the lower end of the medium as a reference, after detecting the lower end of the medium by the sensor and makes the transport mechanism transport the medium by the corrected target transport amount.

Other features of the present invention will be apparent by description of this specification and accompanying drawings.

BRIEF DESCRIPTION OF THE DRAWINGS

FIG. 22 is an explanatory view of a table stored in a memory 63.

FIG. 23A is an explanatory view of a correction value in a first case.

FIG. 23B is an explanatory view of a correction value in a second case.

FIG. 29 is a view for explaining a table of correction values used in the present embodiment.

FIG. 31 is an example of the order of correction values applied when the size of paper in the transport direction is short.

FIG. 32 is an example of the order of correction values applied when the size of paper in the transport direction is long.

Figure 1:
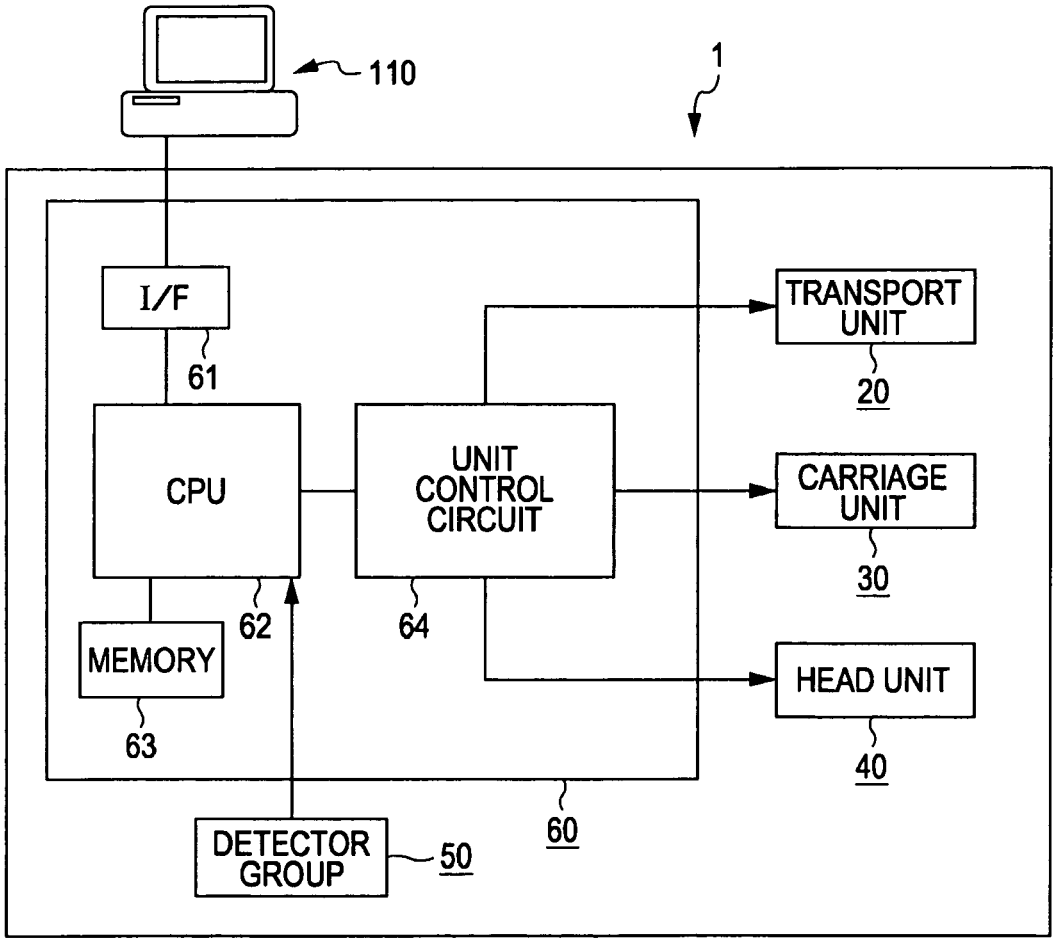
FIG. 1 is a block diagram illustrating the entire configuration of a printer.

1: printer, 110: computer,
20: transport unit, 21: paper feed roller, 22: transport motor, 23: transport roller,
24: platen, 25: paper discharge roller, 26: driven roller,
27: driven roller,
30: carriage unit, 31: carriage, 32: carriage motor,
40: head unit, 41: head,
50: detector group, 51: linear encoder,
52: rotary encoder, 521: scale, 522: detection portion,
53: paper detecting sensor, 54: optical sensor,
60: controller, 61: interface portion, 62: CPU, 63: memory,
64: unit control circuit,
150: scanner, 151: top cover, 152: document stand glass,
153: reading carriage, 154: guide portion, 155: moving mechanism,
157: exposure lamp, 158: line sensor, 159: optical system,
TS: test sheet, SS: reference sheet

DESCRIPTION OF PREFERRED EMBODIMENTS

At least the following matters will be apparent by description of this specification and accompanying drawings.

A recording apparatus including: (A) a head for performing recording on a medium, (B) a transport mechanism that includes a roller on an upstream side of the head and transports the medium in the transport direction according to a target transport amount that is targeted, (C) a memory that stores a plurality of correction values which are correction values for correcting the target transport amount when transporting the medium and which are matched with a relative position of the head and the medium, (D) a sensor that is provided at a more upstream side than the upstream-side roller in order to detect a lower end of the medium transported in the transport direction, and (E) a controller that corrects the target transport amount by a correction value, which is matched with the relative position with an upper end of the medium as a reference, and makes the transport mechanism transport the medium by the corrected target transport amount and that corrects the target transport amount by a correction value, which is matched with the relative position with the lower end of the medium as a reference, after detecting the lower end of the medium by the sensor and makes the transport mechanism transport the medium by the corrected target transport amount.

In this way, it is possible to perform transport by correcting the transport amount while modifying the relative position of a correction value applied for transport of a medium.

In the recording apparatus, it is preferable that the transport mechanism further include a roller on a downstream side of the head in order to transport the medium in the transport direction and when the lower end of the medium is not detected even if transport up to the relative position at which the lower end of the medium is to be detected is performed, the controller transport the medium while correcting the target transport amount such that some of correction values used when transport by both the roller provided on the upstream side and the roller on the downstream side is performed are used multiple times. In addition, it is preferable that the transport mechanism further include a roller on a downstream side of the head in order to transport the medium in the transport direction and when the lower end of the medium is detected before transport up to the relative position at which the lower end of the medium is to be detected is performed, the controller transport the medium while correcting the target transport amount such that some of correction values used when transport by both the roller provided on the upstream side and the roller on the downstream side is performed are not used. In addition, it is preferable that each of the correction values be matched with a range of the relative position to which the correction value is to be applied and the controller correct the target transport amount by giving weight to the correction value according to a ratio of a range, in which the relative position at the time of transport with the target transport amount changes, and the range of the relative position at which the correction value is to be applied.

In this way, it is possible to perform transport by correcting the transport amount while modifying the relative position of a correction value applied for transport of a medium.

A transport amount correcting method including: a step of storing a plurality of correction values which are correction values for correcting a target transport amount when transporting a medium and which are matched with a relative position of a head and the medium; a step of correcting the target transport amount by a correction value, which is matched with the relative position with an upper end of the medium as a reference, and transporting the medium by the corrected target transport amount; and a step of correcting the target transport amount by a correction value, which is matched with the relative position with a lower end of the medium as a reference, after a sensor provided at a more upstream side than an upstream-side roller detects the lower end of the medium transported in the transport direction and transporting the medium by the corrected target transport amount.

In this way, it is possible to perform transport by correcting the transport amount while modifying the relative position of a correction value applied for transport of a medium.

A program for operating a transport amount correcting device that causes the transport amount correcting device to perform: a step of storing a plurality of correction values which are correction values for correcting a target transport amount when transporting a medium and which are matched with a relative position of a head and the medium; a step of correcting the target transport amount by a correction value, which is matched with the relative position with an upper end of the medium as a reference, and transporting the medium by the corrected target transport amount; and a step of correcting the target transport amount by a correction value, which is matched with the relative position with a lower end of the medium as a reference, after a sensor provided at a more upstream side than an upstream-side roller detects the lower end of the medium transported in the transport direction and transporting the medium by the corrected target transport amount.

In this way, it is possible to perform transport by correcting the transport amount while modifying the relative position of a correction value applied for transport of a medium.

===Configuration of a Printer===

<Regarding the Configuration of an Ink Jet Printer>

Figure 2A:
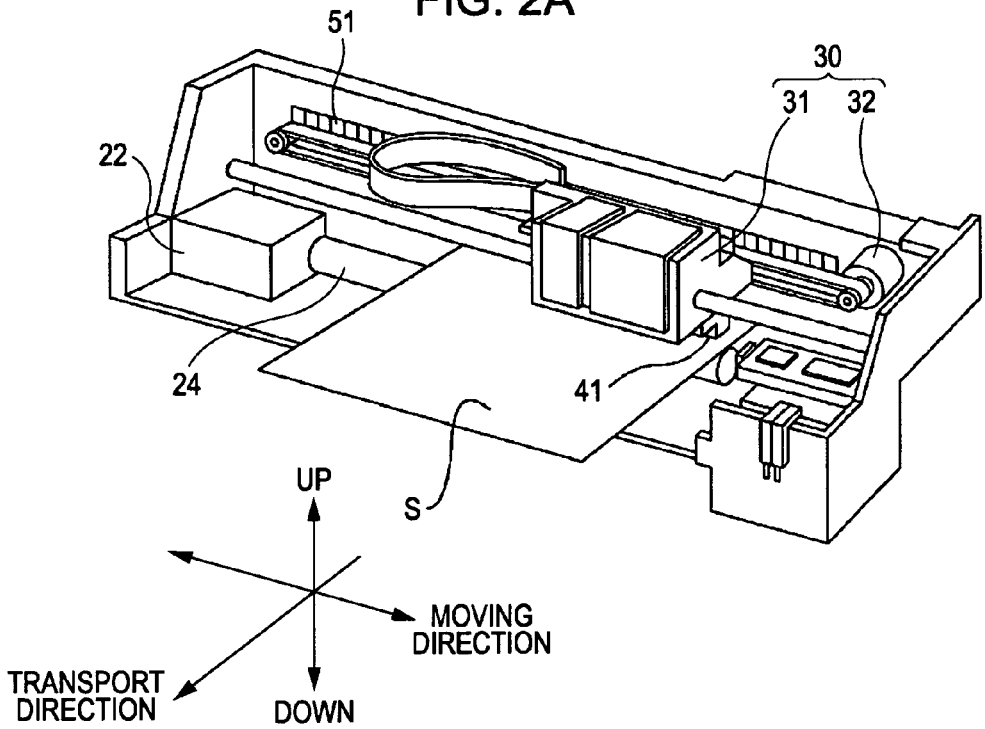
FIG. 2A is a schematic view illustrating the entire configuration of a printer 1.
Figure 2B:
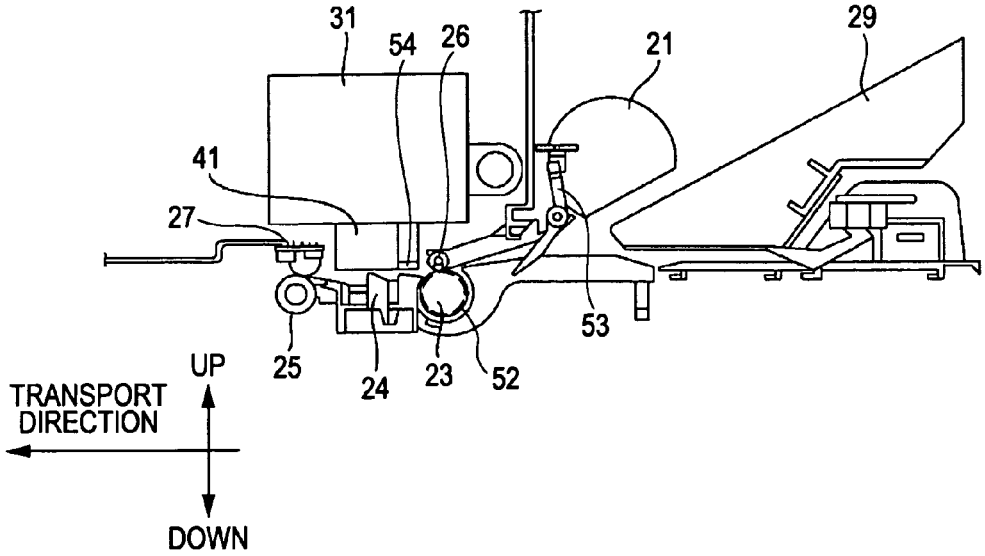
FIG. 2B is a transverse sectional view of the entire configuration of the printer 1.

FIG. 1 is a block diagram of the entire configuration of a printer 1. In addition, FIG. 2A is a schematic view of the entire configuration of the printer 1. In addition, FIG. 2B is a transverse sectional view of the entire configuration of the printer 1. Hereinafter, the basic configuration of the printer will be described.

The printer 1 includes a transport unit 20, a carriage unit 30, a head unit 40, a detector group 50, and a controller 60. The printer 1 that has received print data from a computer 110, which is an external apparatus, controls each of the units (the transport unit 20, the carriage unit 30, and the head unit 40) by using the controller 60. The controller 60 controls each unit on the basis of the print data received from the computer 110 and prints an image on paper. The situation in the printer 1 is monitored by the detector group 50, and the detector group 50 outputs a detection result to the controller 60. The controller 60 controls each unit on the basis of the detection result output from the detector group 50.

The transport unit 20 serves to transport a medium (for example, paper S) in a predetermined direction (hereinafter, called a transport direction). The transport unit 20 has a paper feed roller 21, a transport motor 22 (also called a PF motor), a transport roller 23, a platen 24, and a paper discharge roller 25. The paper feed roller 21 is a roller for feeding the paper inserted in a paper insert hole into the printer. The transport roller 23 is a roller that transports the paper S fed by the paper feed roller 21 up to a printable region and is driven by the transport motor 22. The platen 24 supports the paper S being printed. The paper discharge roller 25 is a roller that discharges the paper S to the outside of the printer and is provided at a downstream side of the transport direction with respect to the printable region. The paper discharge roller 25 rotates in synchronization with the transport roller 23.

In addition, when the transport roller 23 transports the paper S, the paper S is interposed between the transport roller 23 and a driven roller 26. Thus, the posture of the paper S is stabilized. On the other hand, when the paper discharge roller 25 transports the paper S, the paper S is interposed between the paper discharge roller 25 and a driven roller 27. Since the paper discharge roller 25 is provided at a more downstream side of the transport direction than the printable region, the driven roller 27 is configured such that a surface being in contact with the paper S is small (also see FIG. 4). Accordingly, when the lower end of the paper S passes the transport roller 23 and the paper S is transported by only the paper discharge roller 25, the posture of the paper S becomes unstable easily and the transport characteristic also changes easily.

The carriage unit 30 serves to move (also called 'scan') a head in a predetermined direction (hereinafter, called a moving direction). The carriage unit 30 has a carriage 31 and a carriage motor 32 (also called a CR motor). The carriage 31 can reciprocate in the moving direction and is driven by the carriage motor 32. In addition, the carriage 31 detachably holds an ink cartridge that contains ink therein.

The head unit 40 serves to discharge ink onto the paper. The head unit 40 includes a head 41 having a plurality of nozzles. Since the head 41 is provided on the carriage 31, the head 41 also moves in the moving direction when the carriage 31 moves in the moving direction. In addition, a dot line (raster line) along the moving direction is formed on the paper by discharging ink intermittently while the head 41 is moving in the moving direction.

A linear encoder 51, a rotary encoder 52, a paper detecting sensor 53, and an optical sensor 54 are included in the detector group 50. The linear encoder 51 detects the position of the carriage 31 in the moving direction. The rotary encoder 52 detects the rotation amount of the transport roller 23. The paper detecting sensor 53 detects positions of front and rear ends of paper being fed. The optical sensor 54 detects whether or not the paper exists by a light receiving portion and a light-emitting portion attached to the carriage 31. In addition, the optical sensor 54 can detect the position of the end of the paper while being moved by the carriage 31 and can detect the width of the paper. In addition, the optical sensor 54 may also detect the front end (which is an end at a downstream side in the transport direction and is also called an upper end) and the rear end of (which is an end at an upstream side in the transport direction and is also called a lower end) of the paper according to a situation.

The controller 60 is a control unit for controlling the printer. The controller 60 includes an interface portion 61, a CPU 62, a memory 63, and a unit control circuit 64. The interface portion 61 performs transmission and reception of data between the printer 1 and the computer 110 that is an external apparatus. The CPU 62 is a processing unit for making an overall control of the printer. The memory 63 serves to secure a region for storing a program of the CPU 62, a working area, and the like and has memory devices, such as a RAM and an EEPROM. The CPU 62 controls each unit through the unit control circuit 64 according to the program stored in the memory 63.

<Regarding a Nozzle>

Figure 3:
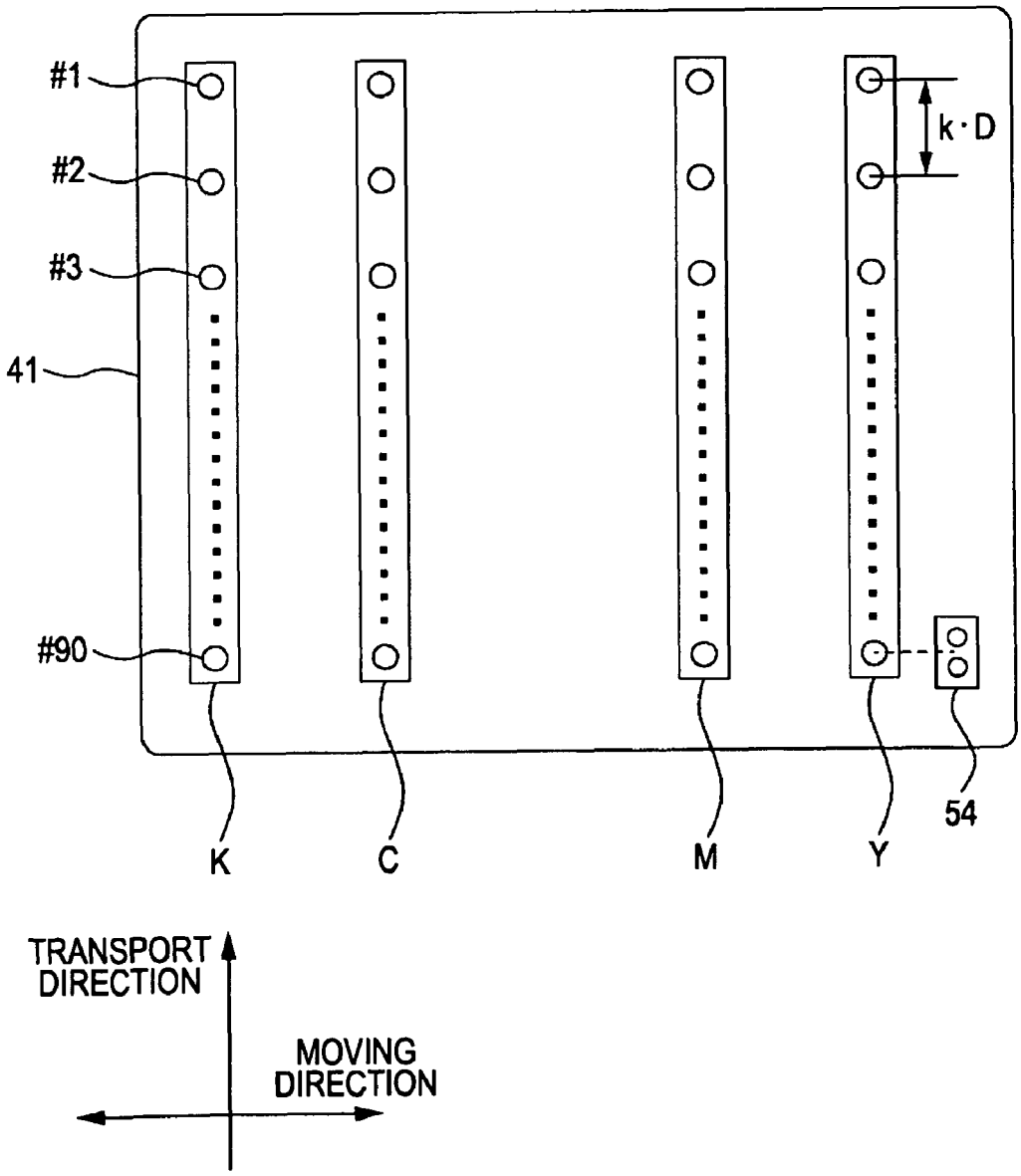
FIG. 3 is an explanatory view illustrating the arrangement of nozzles.

FIG. 3 is an explanatory view illustrating the arrangement of nozzles on a bottom surface of the head 41. A black ink nozzle group K, a cyan ink nozzle group C, a magenta ink nozzle group M, and a yellow ink nozzle group Y are formed on the bottom surface of the head 41. Each nozzle group includes 90 nozzles that are discharge holes for discharging ink of each color.

A plurality of nozzles of each nozzle group are arrayed at fixed distances (nozzle pitch: k·D) therebetween along the transport direction. Here, D is a minimum dot pitch (that is, a distance between dots formed on the paper S at the highest resolution) in the transport direction. In addition, k is one or more integers. For example, when the nozzle pitch is 90 dpi (1/90 inch) and the dot pitch in the transport direction is 720 dpi (1/720 inch), k=8.

To nozzles of each nozzle group, numbers as small as downstream-side nozzles are given (#1-#90). That is, the nozzle #1 is located at the more downstream side in the transport direction than the nozzle #90. In addition, the above-described optical sensor 54 is at almost the same position as the nozzle #90 that is at the most upstream side regarding the position in the paper transport direction.

An ink chamber (not shown) and a piezoelectric element are provided in each nozzle. The ink chamber expands and contracts by driving of the piezoelectric element, and an ink droplet is discharged from the nozzle.

===Transport Error===

<Regarding Transport of Paper>

Figure 4:
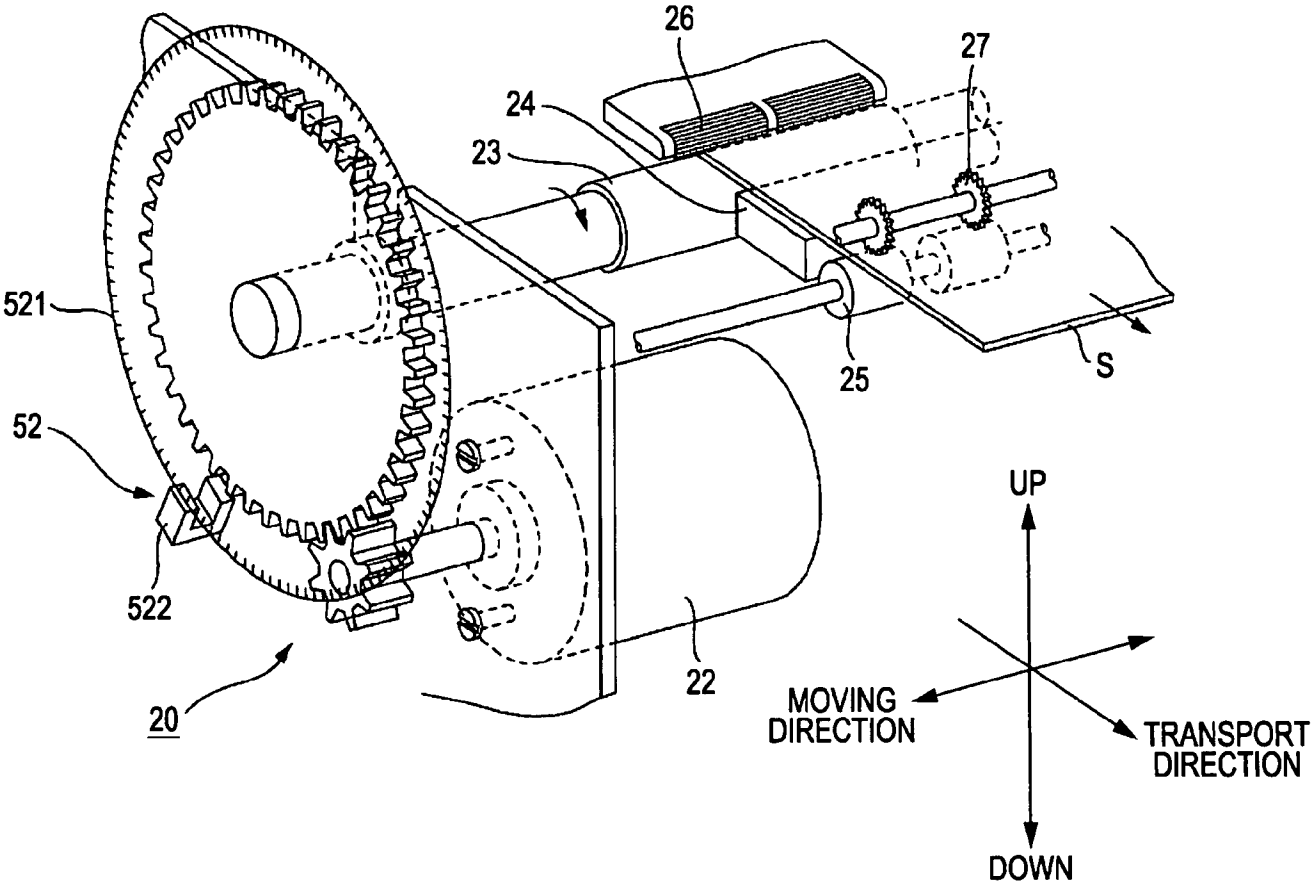
FIG. 4 is an explanatory view of the configuration of a transport unit 20.

FIG. 4 is an explanatory view of the configuration of the transport unit 20.

The transport unit 20 drives the transport motor 22 with a predetermined driving amount on the basis of a transport command from the controller 60. The transport motor 22 generates a driving force in the rotation direction according to the driving amount commanded. The transport motor 22 rotates the transport roller 23 using the driving force. That is, the transport roller 23 rotates with the predetermined rotation amount when the transport motor 22 generates the predetermined driving amount. When the transport roller 23 rotates with the predetermined rotation amount, the paper is transported with the predetermined transport amount.

The transport amount of the paper is set according to the rotation amount of the transport roller 23. Here, it is assumed that when the transport roller 23 makes 1 rotation, the paper is transported by 1 inch (that is, the circumference of the transport roller 23 is 1 inch). For this reason, when the transport roller 23 makes ¼ rotation, the paper is transported by ¼ inch.

Accordingly, if the rotation amount of the transport roller 23 is detectable, the transport amount of the paper can also be detected. Therefore, in order to detect the rotation amount of the transport roller 23, the rotary encoder 52 is provided.

The rotary encoder 52 has a scale 521 and a detection portion 522. The scale 521 has many slits provided for every predetermined distance. The scale 521 is provided in the transport roller 23. That is, the scale 521 rotates together when the transport roller 23 rotates. In addition, when the transport roller 23 rotates, the respective slits of the scale 521 sequentially pass the detection portion 522. The detection portion 522 is provided to face the scale 521 and is fixed to the body side of the printer. The rotary encoder 52 outputs a pulse signal whenever a slit provided in the scale 521 passes the detection portion 522. Since the slits provided in the scale 521 sequentially pass the detection portion 522 according to the rotation amount of the transport roller 23, the rotation amount of the transport roller 23 is detected on the basis of the output of the rotary encoder 52.

In addition, for example, in case of transporting the paper with a transport amount of 1 inch, the controller 60 drives the transport motor 22 until the rotary encoder 52 detects that the transport roller 23 has made 1 rotation. Thus, the controller 60 drives the transport motor 22 to transport the paper with a target transport amount until the rotary encoder 52 detects reaching the rotation amount corresponding to a transport amount targeted (target transport amount).

In addition, since the circumference of the paper discharge roller 25 is also 1 inch, the paper is transported by 1 inch when the paper discharge roller 25 makes 1 rotation. As described above, since the paper discharge roller 25 rotates in synchronization with the transport roller 23, the rotation amount of the paper discharge roller 25 can also be detected on the basis of the output of the rotary encoder 52.

<Regarding a Transport Error>

By the way, the rotary encoder 52 detects the rotation amount of the transport roller 23 directly and does not detect the transport amount of the paper S strictly speaking. Accordingly, when the rotation amount of the transport roller 23 does not match the transport amount of the paper S, the rotary encoder 52 cannot detect the transport amount of the paper S correctly and a transport error (detection error) occurs. There are two kinds of transport errors of a transport error of a DC component and a transport error of an AC component.

The transport error of the DC component is a transport error of a predetermined amount occurring when a transport roller makes 1 rotation. It is thought as a cause of the transport-error of the DC component that the circumference of the transport roller 23 changes for every printer due to a manufacturing error and the like. That is, the transport error of the DC component is a transport error occurring because the circumference of the transport roller 23 designed is different from the circumference of the actual transport roller 23. The transport error of the DC component is constant regardless of a starting position when the transport roller 23 makes 1 rotation. However, the actual transport error of the DC component becomes a different value according to the total transport amount of the paper due to an influence of friction of paper and the like (which will be described later). In other words, the actual transport error of the DC component becomes a different value according to the relative positional relationship of the paper S and the transport roller 23 (or the paper S and the head 41).

The transport error of the AC component is a transport error corresponding to the location of a peripheral surface of a transport roller used at the time of transport. The transport error of the AC component becomes a different amount according to the location of the peripheral surface of the transport roller used at the time of transport. That is, the transport error of the AC component becomes a different amount according to the rotation position and the rotation amount of the transport roller at the start of transport.

Figure 5:
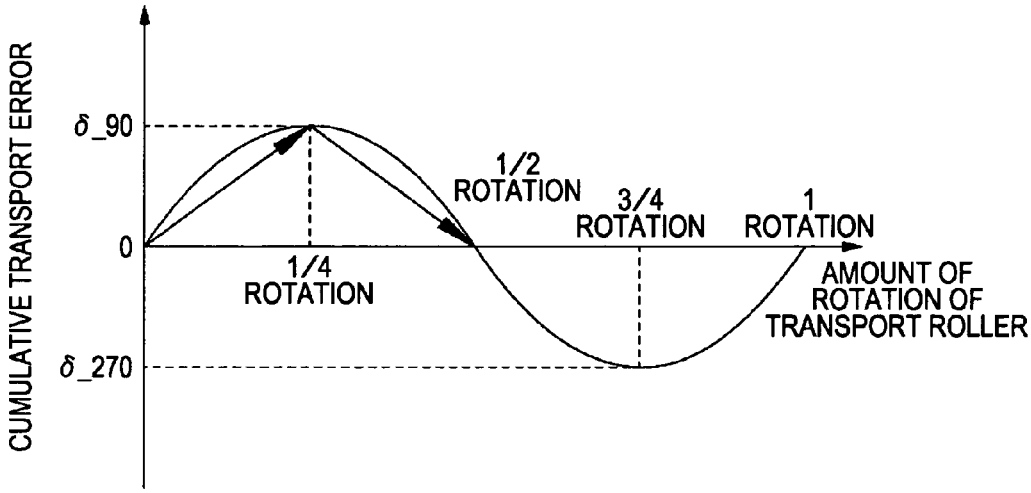
FIG. 5 is a graph for explanation of a transport error of an AC component.

FIG. 5 is a graph for explaining the transport error of the AC component. A horizontal axis is a rotation amount of the transport roller 23 from a rotation position as a reference. A vertical axis indicates a transport error. If this graph is differentiated, a transport error occurring when the transport roller is transported at the rotation position is derived. Here, a cumulative transport error at the reference position is set to zero, and the transport error of the DC component is also set to zero.

When the transport roller 23 makes ¼ rotation from the reference position, a transport error of δ_90 occurs and the paper is transported by ¼ inch+δ_90. However, when the transport roller 23 further makes ¼ rotation, a transport error of −δ_90 occurs and the paper is transported by ¼ inch−δ_90.

As a cause that the transport error of the AC component occurs, for example, following three causes may be considered.

First of all, an influence caused by the shape of a transport roller is considered. For example, when the transport roller has an elliptical shape or an egg shape, a distance to the rotation center changes according to the location of a peripheral surface of the transport roller. In addition, in the case of transporting a medium in a portion where the distance to the rotation center is long, the transport amount of the transport roller with respect to the rotation amount increases. On the other hand, in the case of transporting a medium in a portion where the distance to the rotation center is short, the transport amount of the transport roller with respect to the rotation amount decreases.

Secondly, the eccentricity of a rotary shaft of a transport roller is considered. Also in this case, the length to the rotation center changes according to the location of the peripheral surface of the transport roller. For this reason, the transport amount changes according to the location of the peripheral surface of the transport roller even if the rotation amount of the transport roller is equal.

Thirdly, mismatch between the rotary shaft of the transport roller and the center of the scale 521 of the rotary encoder 52 is considered. In this case, the scale 521 eccentrically rotates. As a result, according to the location of the scale 521 that the detection portion 522 detects, the rotation amount of the transport roller 23 with respect to a detected pulse signal changes. For example, when the location of the scale 521 detected is distant from the rotary shaft of the transport roller 23, the transport amount decreases since the rotation amount of the transport roller 23 with respect to a detected pulse signal decreases. On the other hand, when the location of the scale 521 detected is near from the rotary shaft of the transport roller 23, the transport amount increases since the rotation amount of the transport roller 23 with respect to a detected pulse signal increases.

Due to the above reasons, the transport error of the AC component becomes an almost sign curve as shown in FIG. 5.

<Transport Error to be Corrected>

Figure 6:
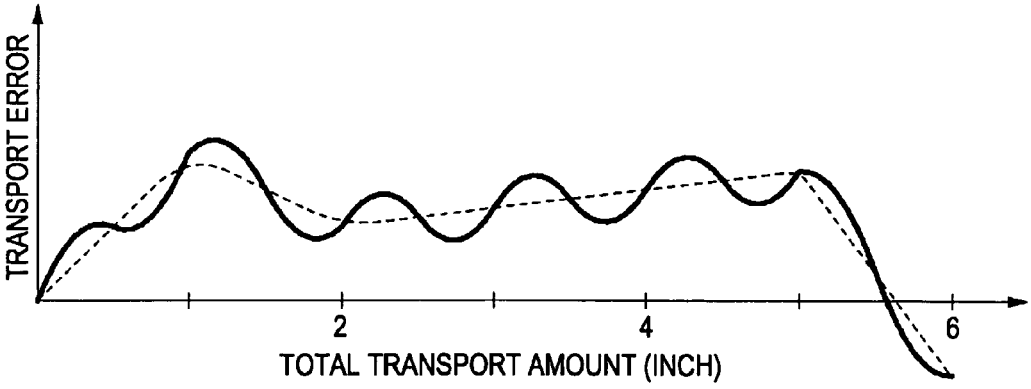
FIG. 6 is a graph (conceptual view) of a transport error occurring when transporting paper.

FIG. 6 is a graph (conceptual view) of a transport error occurring when transporting paper with a size of 101.6 mm×152.4 mm (4 inches×6 inches). A horizontal axis of the graph indicates the total transport amount of the paper. A vertical axis of the graph indicates the transport error. A dotted line in the drawing is a graph of a transport error of a DC component. If a value (transport error of a DC component) of the dotted line in the drawing is subtracted from a value (total transport error) of a solid line in the drawing, a transport error of an AC component is calculated. The transport error of the AC component becomes an almost sign curve regardless of the total transport amount of the paper. On the other hand, the transport error of the DC component shown by the dotted line becomes a different value according to the total transport amount of the paper due to an influence of friction of paper and the like.

As already described, the transport error of the AC component is different according to the location of the peripheral surface of the transport roller 23. Accordingly, since the transport error of the AC component is different if the rotation position of the transport roller 23 at the start of transport is different even in the case where the same paper is transported, the total transport error (transport error shown by the solid line of the graph) becomes different. On the other hand, since the transport error of the DC component is not related to the location of the peripheral surface of the transport roller unlike the transport error of the AC component, the transport error (transport error of the DC component) occurring when the transport roller 23 makes 1 rotation becomes equal even if the rotation position of the transport roller 23 at the start of transport is different.

In addition, in case of correcting the transport error of the AC component, the controller 60 needs to detect the rotation position of the transport roller 23. However, in order to detect the rotation position of the transport roller 23, it is necessary to further prepare an origin sensor in the rotary encoder 52, which increases the cost.

Therefore, in correction of the transport amount in a reference example shown below, the transport error of the DC component is corrected.

By the way, the transport error of the DC component becomes a different value according to the total transport amount (in other words, the relative positional relationship between the paper S and the transport roller 23) of the paper (refer to a dotted line of FIG. 6). Accordingly, if more correction values can be prepared according to the positions in the transport direction, the transport error can be corrected accurately. Therefore, in the reference example, a correction value for correcting a transport error of a DC component is prepared for every range of ¼ inch, not for every range of 1 inch equivalent to one rotation of the transport roller 23.

In addition, it is thought that such a transport error also occurs at the time of transport by only the paper discharge roller 25 and the driven roller 27. Accordingly, correction of the transport error of the DC component, which will be described later, can also be used at the time of transport by only the paper discharge roller 25 and the driven roller 27.

===General Explanation===

Figure 7:
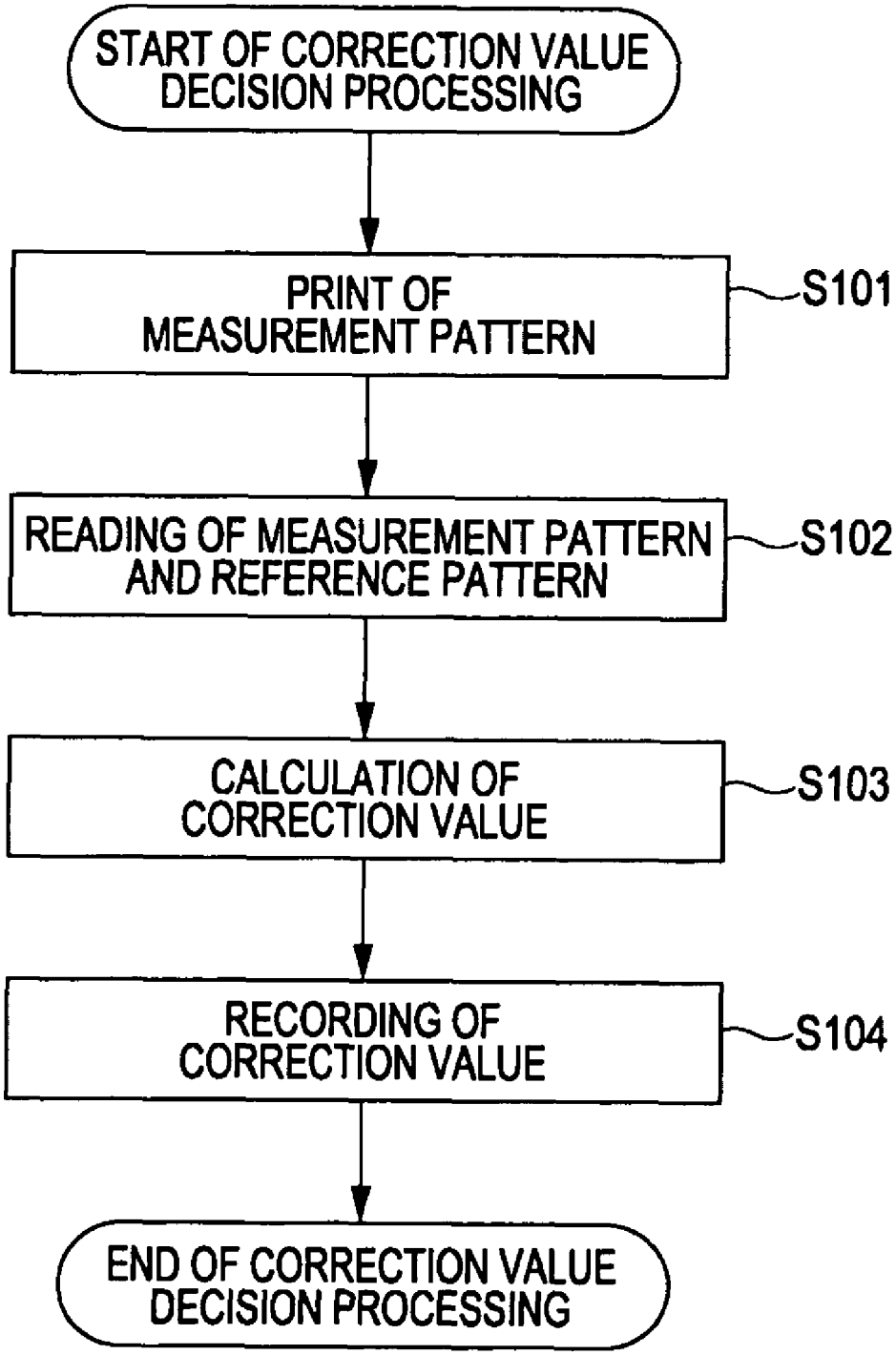
FIG. 7 is a flow chart until a correction value for correcting a transport amount is determined.
Figure 8A:
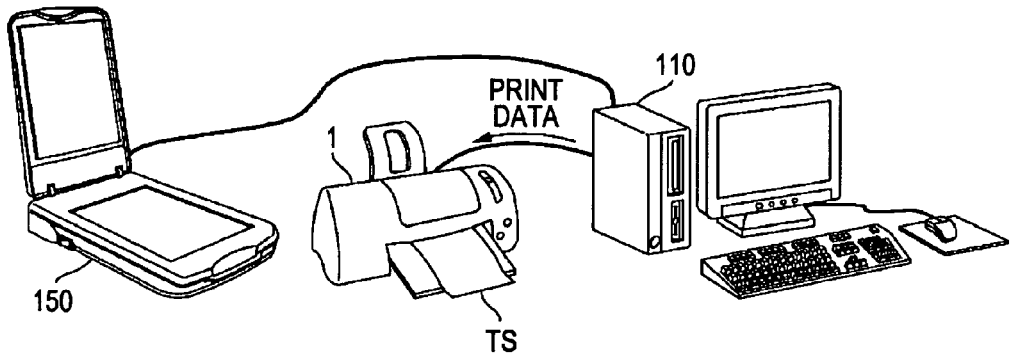
FIGS. 8A to 8C are explanatory views of a situation until a correction value is determined.
Figure 8B:
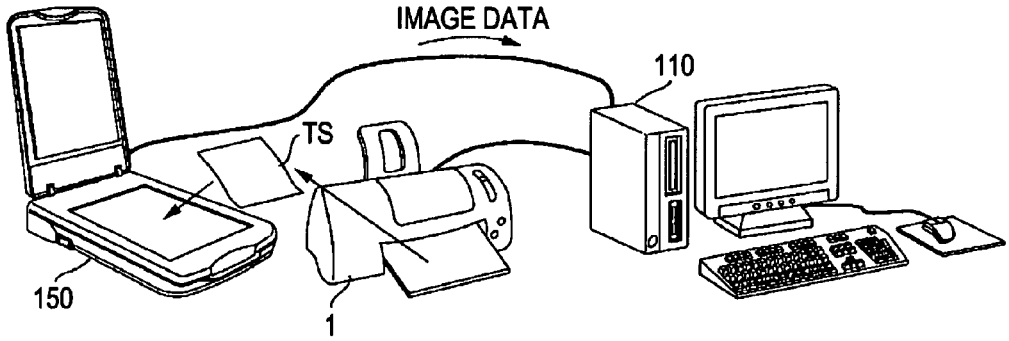
Figure 8C:
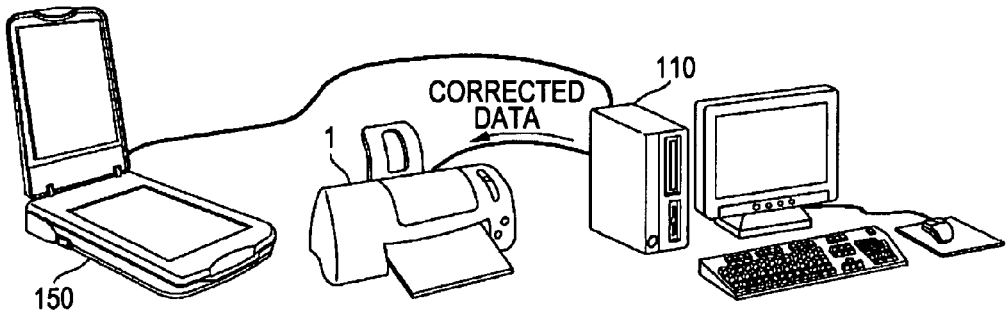

FIG. 7 is a flow chart until a correction value for correcting a transport amount is determined. FIGS. 8A to 8C are explanatory views of a situation until the correction value is determined. The processing is performed in an inspection process of a printer factory. Prior to this processing, an examiner connects the assembled printer 1 to the computer 110 in the factory. A scanner 150 is also connected to the computer 110 in the factory and a printer driver, a scanner driver, and a correction value acquisition program are installed beforehand in the computer 110.

First, the printer driver transmits print data to the printer 1, and the printer 1 prints a measurement pattern on test sheet TS (S101, FIG. 8A). Then, the examiner sets the test sheet TS on the scanner 150, and the scanner driver makes the scanner 150 read the measurement pattern and acquires image data (S102, FIG. 8B). In addition, a reference sheet is set on the scanner 150 together with the test sheet TS, such that a reference pattern drawn on the reference sheet is also read together.

Then, the correction value acquisition program analyzes the acquired image data and calculates a correction value (S103). Then, the correction value acquisition program transmits corrected data to the printer 1 and stores the correction value in the memory 63 of the printer 1 (FIG. 8C). The correction value stored in the printer reflects a transport characteristic of each printer.

In addition, the printer that stores the correction value is packed and sent to a user. When the user prints an image with the printer, the printer transports paper based on the correction value and prints an image on the paper.

===Printing of a Measurement Pattern (S101)===

First, printing of a measurement pattern will be described. Similar to normal printing, the printer 1 prints the measurement pattern by alternately repeating dot forming processing for forming a dot by discharging ink from a nozzle being moved and a transport operation of transporting the paper in the transport direction. Moreover, in the following description, the dot forming processing is called a 'path' and n-th dot forming processing is called 'path n'.

Figure 9:
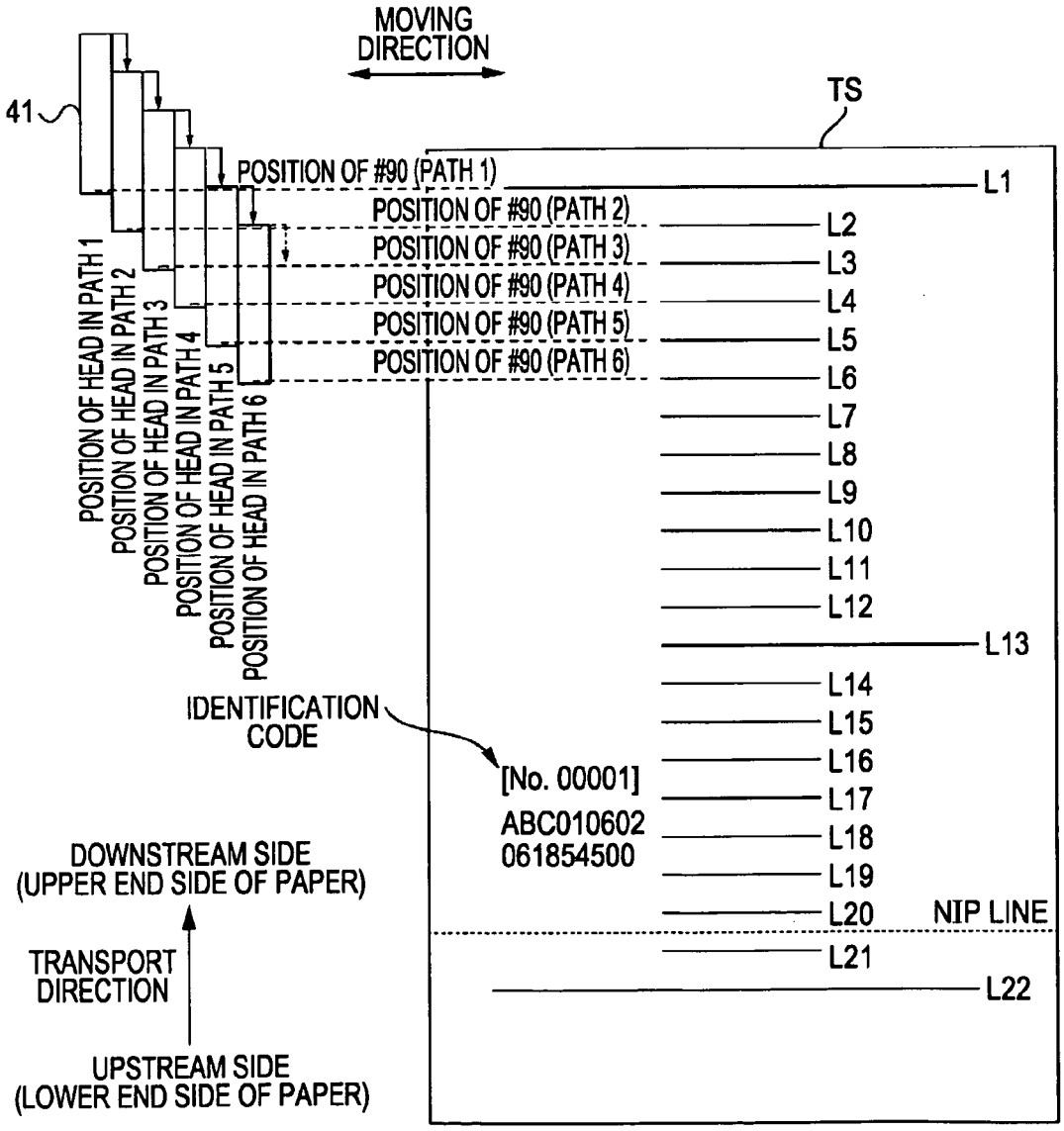
FIG. 9 is an explanatory view illustrating how a measurement pattern is printed.

FIG. 9 is an explanatory view illustrating how a measurement pattern is printed. The size of the test sheet TS on which the measurement pattern is printed is 101.6 mm×152.4 mm (4 inches×6 inches).

On the right side of the drawing, the measurement pattern printed on the test sheet TS is shown. A rectangle on the left side of the drawing indicates the position (relative position with respect to the test sheet TS) of the head 41 at each path. Although the head 41 is drawn to move to the test sheet TS for the sake of explanation, this drawing shows the relative positional relationship between the head and the test sheet TS, and the test sheet TS is intermittently transported in the transport direction actually.

When the test sheet TS continues being transported, the lower end of the test sheet TS passes the transport roller 23. The test sheet TS facing the most upstream nozzle #90 when the lower end of the test sheet TS passes the transport roller 23 is shown as a 'NIP line' by a dotted line in the drawing. That is, in a path where the head 41 is above the NIP line in the drawing, printing is performed in a state (NIP state) where the test sheet TS is interposed between the transport roller 23 and the driven roller 26. Moreover, in a path where the head 41 is below the NIP line in the drawing, printing is performed in a state where there is no test sheet TS between the transport roller 23 and the driven roller 26 (state where the test sheet TS is transported only by the paper discharge roller 25 and the driven roller 27, and this is also called a 'non-NIP state').

The NIP line is decided by a distance between the head and the transport roller 23 of the printer 1 and was at a position facing the nozzle #90 when the lower end of the paper passes the transport roller 23 as described above. Here, a position of a distance of Dn from the lower end of the paper is the NIP line.

The measurement pattern is configured to include an identification code and a plurality of lines.

The identification code is an individual identification symbol for identifying each printer 1. This identification code is read together when the measurement pattern is read in S102 and is identified by the computer 110 by a character recognition using OCR.

Each line is formed along the moving direction. An i-th line is called 'Li' sequentially from the upper end side. A specific line is formed longer than other lines. For example, a line L1, a line L13, and a line L22 are formed long compared with the other lines. These lines are formed as follows.

First, the test sheet TS is transported to a predetermined print starting position, and then an ink droplet is discharged only from the nozzle #90 and the line L1 is formed in a path 1. After the path 1, the controller 60 causes the transport roller 23 to make ¼ rotation to thereby transport the test sheet TS by about ¼ inch. After the transport, an ink droplet is discharged only from the nozzle #90 and a line L2 is formed in a path 2. Hereinafter, the same operation is repeatedly performed and lines L1 to L22 are formed at distances of about ¼ inch. Thus, the lines L1 to L22 are formed by the most upstream nozzle #90 of the nozzles #1 to #90. In addition, although the lines L1 to L22 are formed only by the nozzle #90, nozzles other than the nozzle #90 are also used in printing the identification code in a path where the identification code is printed.

By the way, when transport of the test sheet TS is ideally performed, a line space of the lines L1 to L22 should be exactly ¼ inch. However, when there is a transport error, the line space will not become ¼ inch. If the test sheet TS is transported more than the ideal transport amount, the line space becomes wide. On the contrary, if the test sheet TS is transported less than the ideal transport amount, the line space becomes narrow. That is, a space between certain two lines reflects a transport error in transport processing performed between a path where one line is formed and a path where the other line is formed. Therefore, by measuring the space between two lines, it is possible to measure a transport error in transport processing performed between a path where one line is formed and a path where the other line is formed.

===Reading of a Pattern (S102)===

<Configuration of a Scanner>

First, the configuration of the scanner 150 used for reading of a measurement pattern will be described.

Figure 10A:
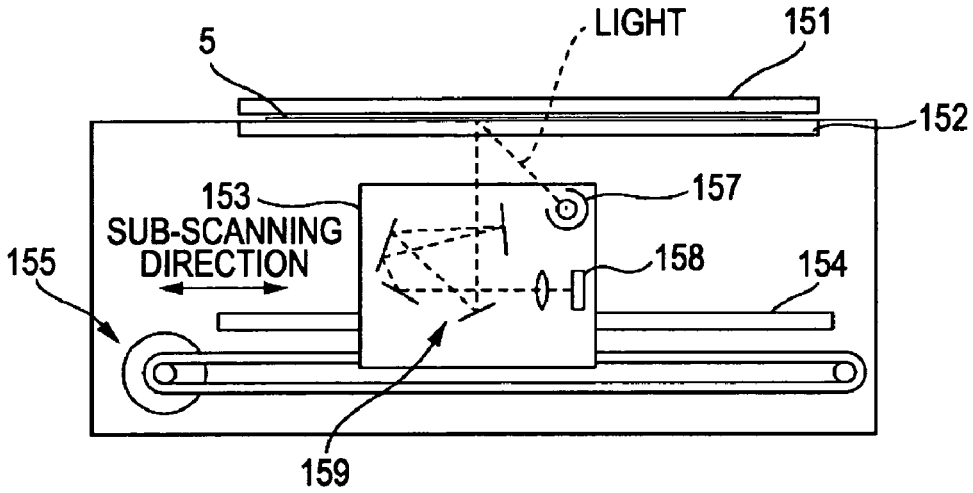
FIG. 10A is a longitudinal sectional view of a scanner 150.
Figure 10B:
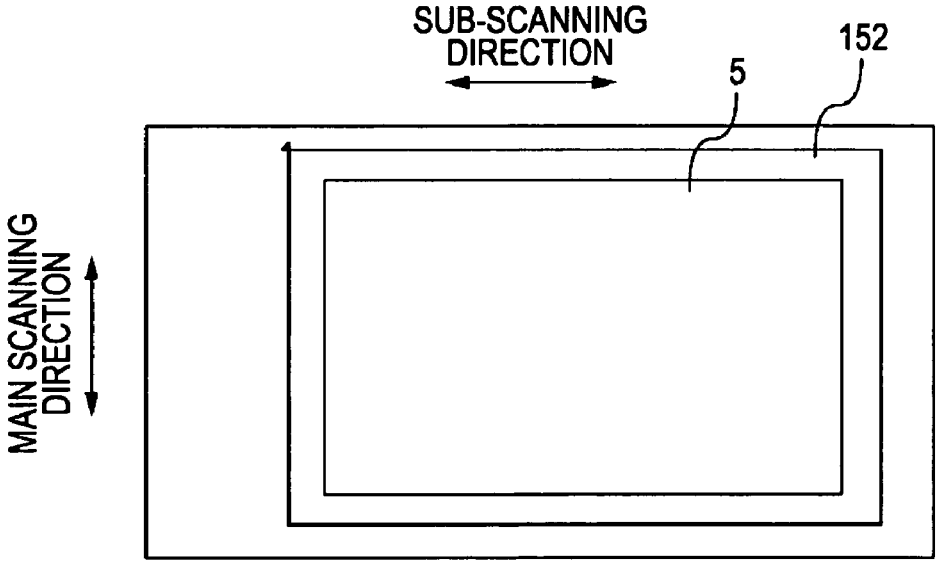
FIG. 10B is a top view of the scanner 150 in a state where a top cover 151 is removed.

FIG. 10A is a longitudinal sectional view of the scanner 150. FIG. 10B is a top view of the scanner 150 in a state where a top cover 151 is removed.

The scanner 150 includes: the top cover 151; a document stand glass 152 on which a document 5 is placed; a reading carriage 153 that moves in a sub-scanning direction while facing the document 5 with the document stand glass 152 interposed therebetween; a guide portion 154 that guides the reading carriage 153 in the sub-scanning direction; a moving mechanism 155 for moving the reading carriage 153; and a scanner controller (not shown) that controls each portion in the scanner 150. An exposure lamp 157 that irradiates light onto the document 5, a line sensor 158 that detects an image of a line in a main scanning direction (direction perpendicular to the paper of FIG. 10A), and an optical system 159 for guiding reflected light from the document 5 to the line sensor 158 are provided in the reading carriage 153. A broken line within the reading carriage 153 in the drawing indicates the locus of light.

When reading an image of the document 5, an operator opens the top cover 151, places the document 5 on the document stand glass 152, and closes the top cover 151. Then, the scanner controller moves the reading carriage 153 along the sub-scanning direction in a state where the exposure lamp 157 is made to emit light and reads the image of a surface of the document 5 by the line sensor 158. The scanner controller transmits the read image data to the scanner driver of the computer 110, so that the computer 110 acquires the image data of the document 5.

<Read Position Accuracy>

In the reference example, the scanner 150 reads a measurement pattern of the test sheet TS and a reference pattern of the reference sheet with a resolution of 720 dpi (main scanning direction)×720 dpi (sub-scanning direction), which will be described later. Therefore, in the following explanation, an explanation will be made assuming that an image is read with the resolution of 720×720 dpi.

Figure 11:
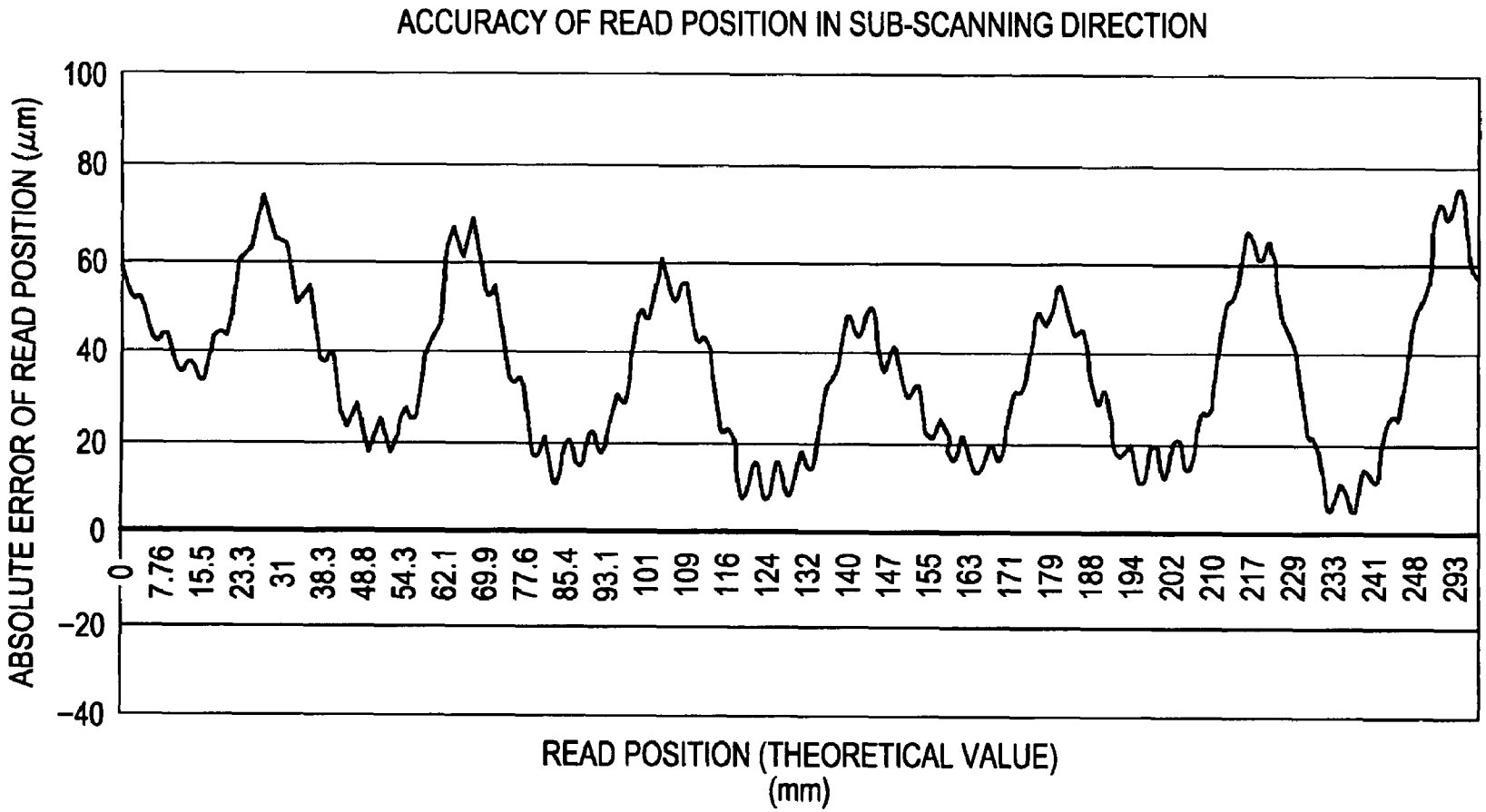
FIG. 11 is a graph of an error of the read position of a scanner.

FIG. 11 is a graph of an error of the read position of a scanner. A horizontal axis of the graph indicates a read position (theoretical value) (that is, the horizontal axis of the graph indicates apposition (theoretical value) of the reading carriage 153). A vertical axis of the graph indicates an error (difference between a theoretical value of a read position and an actual read position) of the read position. For example, when the reading carriage 153 is made to move by 1 inch (=25.4 mm), an error of about 60 μm occurs.

If a theoretical value of the read position and the actual read position match each other, a pixel distant by 720 pixels in the sub-scanning direction from a pixel indicating the reference position (position at which the read position is zero) should show an image at the position distant by exactly 1 inch from the reference position. However, when an error of the read position shown in the graph occurs, the pixel distant by 720 pixels in the sub-scanning direction from the pixel indicating the reference position shows an image at a position further distant by 60 μm from the position distant by 1 inch from the reference position.

In addition, if the inclination of the graph is zero, the image should be read at equal distances every 1/720 inch. However, at a position where the inclination of the graph is plus, an image will be read at distances longer than 1/720 inch. In addition, at a position where the inclination of the graph is minus, an image will be read at distances shorter than 1/720 inch.

As a result, even if lines of the measurement pattern are formed at equal distances, a distance between images of the lines on the image data does not become equal in a state where there is an error of the read position. Thus, in the state where there is an error of the read position, the position of a line cannot be correctly measured only by reading the measurement pattern.

Therefore, here, the reference pattern is also read by setting the reference sheet when setting the test sheet TS and making the scanner read the measurement pattern.

<Reading of a Measurement Pattern and a Reference Pattern>

Figure 12A:
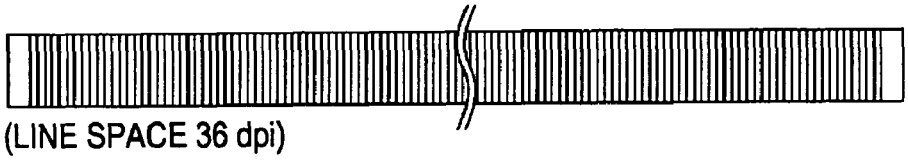
FIG. 12A is an explanatory view of a reference sheet SS.
Figure 12B:
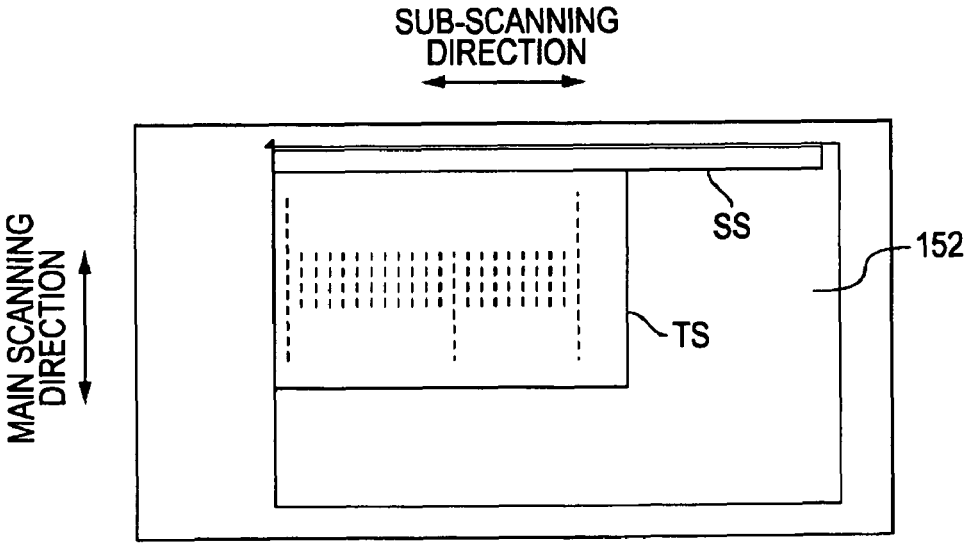
FIG. 12B is an explanatory view illustrating how a test sheet TS and the reference sheet SS are set on a document stand glass 152.

FIG. 12A is an explanatory view of a reference sheet SS. FIG. 12B is an explanatory view illustrating how the test sheet TS and the reference sheet SS are set on the document stand glass 152.

The size of the reference sheet SS is 10 mm×300 mm, and the reference sheet SS has a long and narrow shape. On the reference sheet SS, a plurality of lines are formed as a reference pattern at distances of 36 dpi. Since the reference sheet SS is repeatedly used, the reference sheet SS is formed of a PET film instead of paper. In addition, the reference pattern is formed with high precision by laser machining.

By using a jig (not shown), the test sheet TS and the reference sheet SS are set at predetermined positions on the document stand glass 152. The reference sheet SS is set on the document stand glass 152 such that a long side thereof is parallel to the sub-scanning direction of the scanner 150, that is, each line of the reference sheet SS is parallel to the main scanning direction of the scanner 150. The test sheet TS is set beside the reference sheet SS. The test sheet TS is set on the document stand glass 152 such that a long side thereof is parallel to the sub-scanning direction of the scanner 150, that is, each line of the measurement pattern is parallel to the main scanning direction.

Thus, in a state where the test sheet TS and the reference sheet SS are set, the scanner 150 reads the measurement pattern and the reference pattern. At this time, an image of the measurement pattern in a reading result becomes a distorted image compared with an actual measurement pattern due to the influence of the error of the read position. Similarly, an image of the reference pattern also becomes a distorted image compared with the actual reference pattern.

In addition, an image of the measurement pattern in a reading result is influenced not only by the error of the read position but also by the transport error of the printer 1. On the other hand, since the reference pattern is formed at equal distances regardless of the transport error of the printer, an image of the reference pattern is influenced by the error of the read position of the scanner 150 but is not influenced by the transport error of the printer 1.

Therefore, when calculating a correction value on the basis of the image of the measurement pattern, a correction value acquisition program cancels the influence of the error of the read position on the image of the measurement pattern on the basis of the image of the reference pattern.

===Calculation of a Correction Value (S103)===

Before explaining calculation of a correction value, the image data acquired from the scanner 150 will be described. The image data is configured to include a plurality of pixel data. Each pixel data indicates a gray-scale value of a corresponding pixel. If a reading error of the scanner is neglected, each pixel is equivalent to a size of 1/720 inch×1/720 inch. An image (digital image) is configured with such a pixel as a minimum configuration unit, and the image data is data showing such an image.

Figure 13:
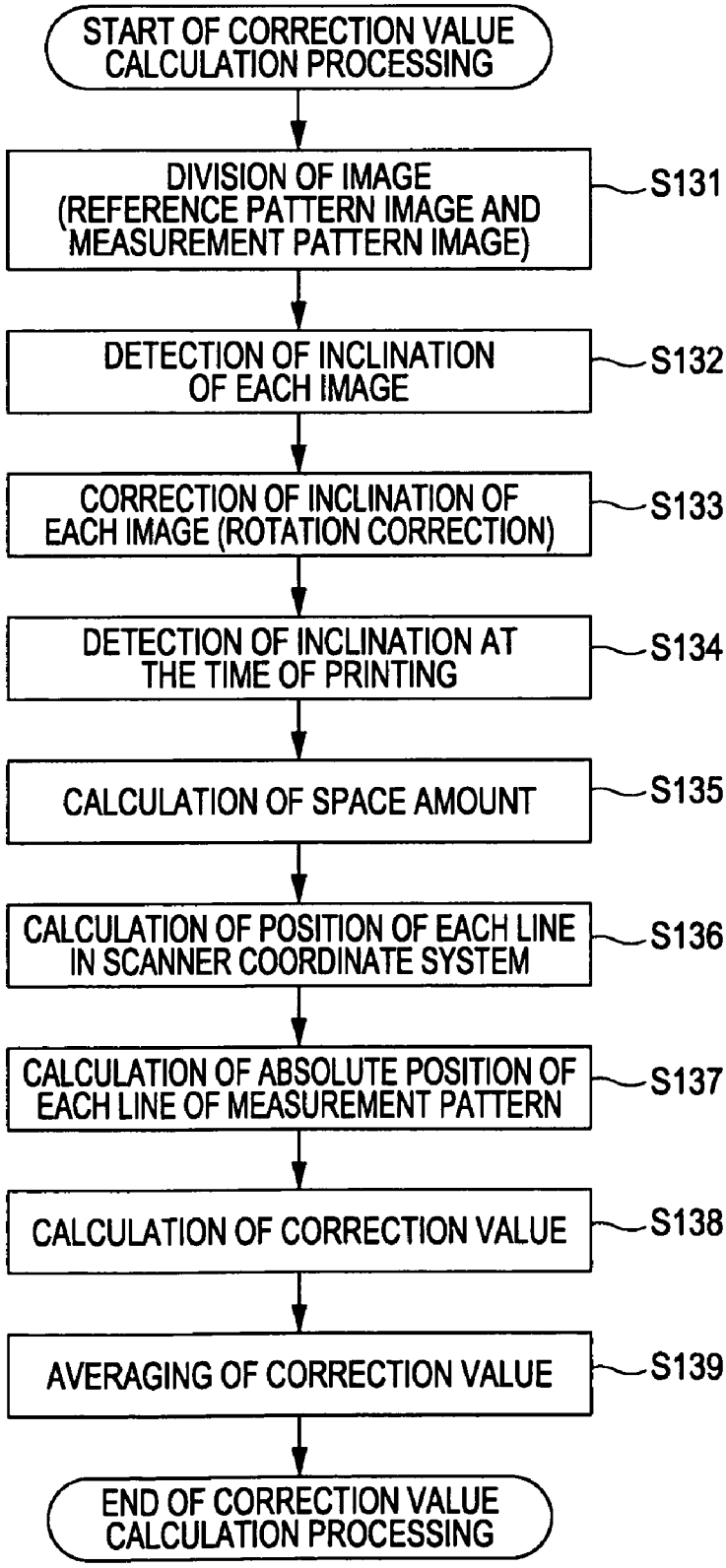
FIG. 13 is a flow chart of correction value calculation processing in S103.

FIG. 13 is a flow chart of the correction value calculation processing in S103. The computer 110 executes each processing according to a correction value acquisition program. That is, the correction value acquisition program has a code for causing the computer 110 to execute each processing.

<Division of an Image (S131)>

First, the computer 110 divides an image, which is shown by the image data acquired from the scanner 150, into two images (S131).

Figure 14:
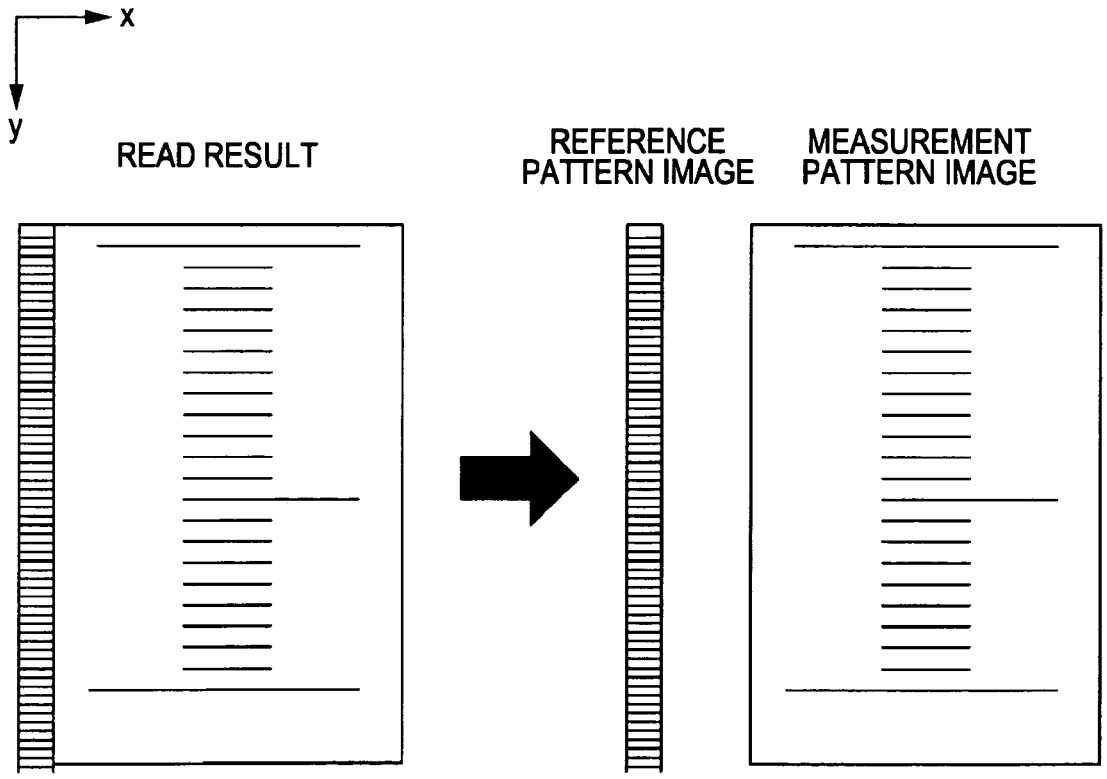
FIG. 14 is an explanatory view of division of an image (S131).

FIG. 14 is an explanatory view of division of the image (S131). On a left side of the drawing, the image shown by the image data acquired from the scanner is drawn. On a right side of the drawing, the divided images are drawn. In the following explanation, a left and right direction (horizontal direction) in the drawing is called an x direction, and an up and down direction (vertical direction) in the drawing is called a y direction. Respective lines in the image of the reference pattern are almost parallel to the x direction, and respective lines in the image of the measurement pattern are almost parallel to the y direction.

The computer 110 divides the image into two images by extracting an image in a predetermined range from the image of the reading result. By dividing the image of the reading result into two images, one image indicates an image of the reference pattern and the other image indicates an image of the measurement pattern. The reason of such dividing is to separately perform inclination correction (S133) since there is a possibility that the reference sheet SS and the test sheet TS will be separately inclined to be set on the scanner 150.

<Detection of Inclination of Each Image (S132)>

Then, the computer 110 detects the inclination of an image (S132).

Figure 15A:
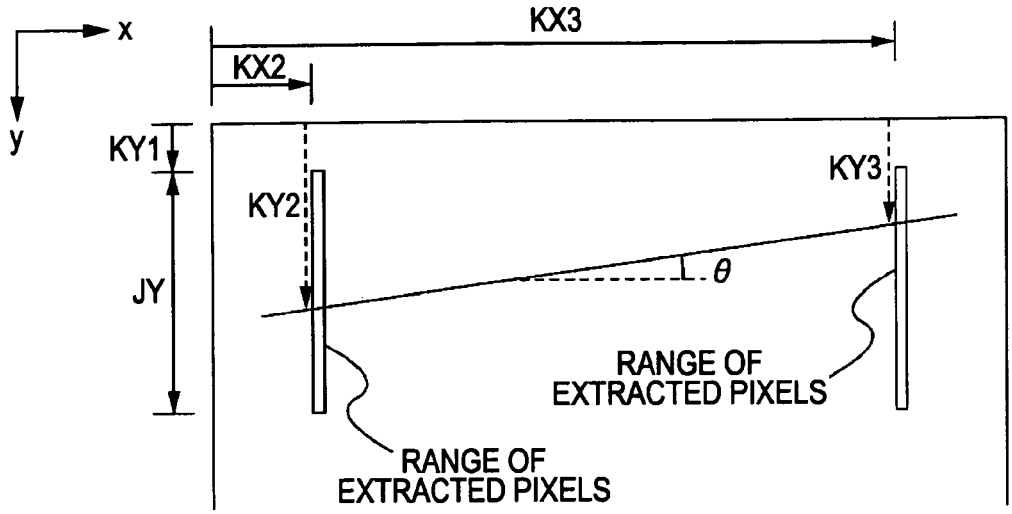
FIG. 15A is an explanatory view illustrating how the inclination of an image of a measurement pattern is detected.

FIG. 15A is an explanatory view illustrating how the inclination of an image of a measurement pattern is detected. The computer 110 extracts JY pixels, which are KX2-th pixels from left and start from a KY1-th pixel from above, from the image data. Similarly, the computer 110 extracts JY pixels, which are KX3-th pixels from left and start from the KY1-th pixel from above, from the image data. In addition, parameters KX2, KX3, KY1, and JY are set such that a pixel showing the line L1 is included in the extracted pixels.

Figure 15B:
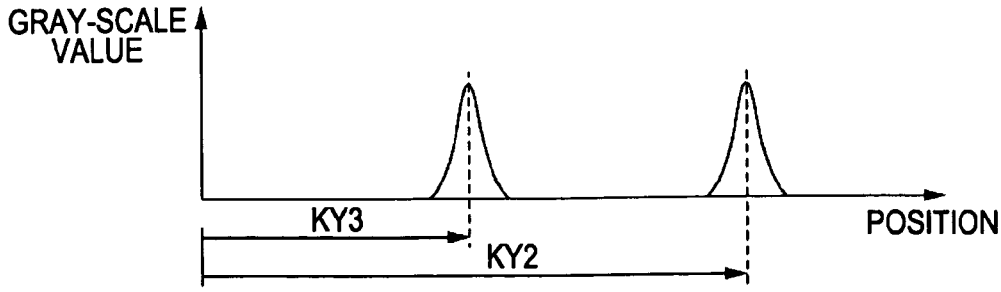
FIG. 15B is a graph of gray-scale values of extracted pixels.

FIG. 15B is a graph of gray-scale values of the extracted pixels. The horizontal indicates the position (Y coordinate) of a pixel. The vertical axis indicates a gray-scale value of the pixel. The computer 110 calculates central positions KY2 and KY3 on the basis of pixel data of the extracted JY pixels.

In addition, the computer 110 calculates the inclination θ of the line L1 by the following expression.

$$\theta=\tan^{-1}\{(KY2-KY3)/(KX2-KX3)\}$$

In addition, the computer 110 detects not only the inclination of an image of a measurement pattern but also the inclination of an image of a reference pattern. Since a method of detecting the inclination of the image of the reference pattern is almost the same as the above-described method, an explanation thereof is omitted.

<Correction of Inclination of Each Image (S133)>

Then, the computer 110 corrects the inclination of the image by performing rotation processing of the image on the basis of the inclination θ detected in S132 (S133). The image of the measurement pattern is subjected to rotation correction on the basis of the inclination result of the image of the measurement pattern, and the image of the reference pattern is subjected to rotation correction on the basis of the inclination result of the image of the reference pattern.

A bilinear method is used for the algorithm of the rotation processing of an image. Since this algorithm is well known, an explanation thereof is omitted.

<Detection of Inclination at the Time of Printing (S134)>

Then, the computer 110 detects the inclination (skew) at the time of printing of the measurement pattern (S134). If the lower end of the test sheet passes the transport roller when printing the measurement pattern, the lower end of the test sheet may come into contact with the head 41 and the test sheet may move. When such a thing happens, a correction value calculated by the measurement pattern becomes unsuitable. Therefore, it is detected whether or not the lower end of the test sheet has come into contact with the head 41 by detecting the inclination at the time of printing of the measurement pattern, and it is set as an error in the case of contact.

Figure 16:
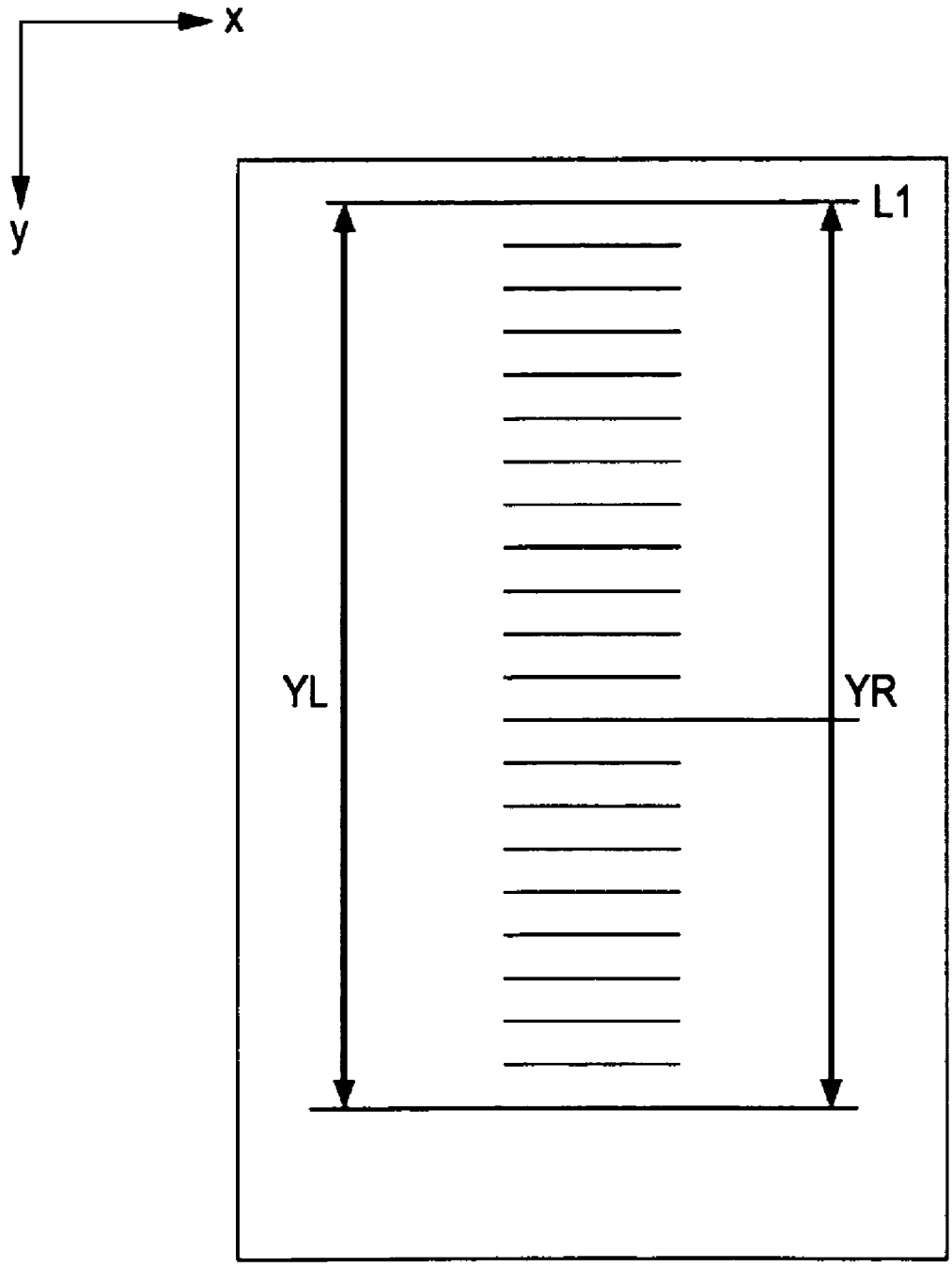
FIG. 16 is an explanatory view illustrating how the inclination is detected at the time of printing of the measurement pattern.

FIG. 16 is an explanatory view illustrating how the inclination is detected at the time of printing of the measurement pattern. First, the computer 110 detects a left space YL and a right space YR in the line L1 (top line) and the line L22. Then, the computer 110 calculates a difference between the space YL and the space YR and proceeds to next processing (S135) if the difference is within a predetermined range and sets an error if the difference is out of the predetermined range.

<Calculation of a Space Amount (S135)>

Then, the computer 110 calculates a space amount (S135).

Figure 17:
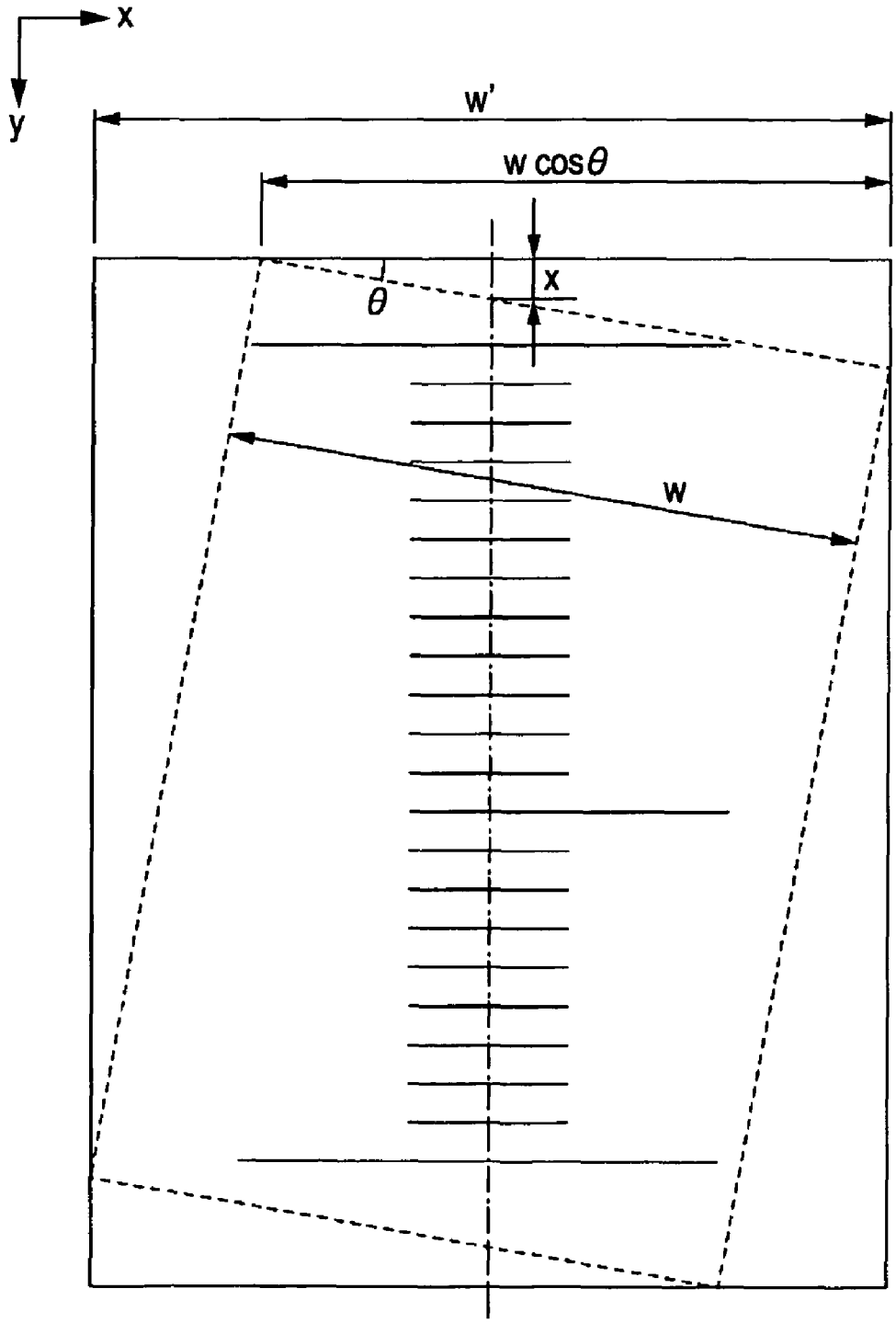
FIG. 17 is an explanatory view of a space amount X.

FIG. 17 is an explanatory view of a space amount X. The rectangle (outer rectangle) of a solid line in the drawing indicates an image after the rotation correction of S133. The rectangle (inner inclined rectangle) of a dotted line in the drawing indicates an image before the rotation correction. In order to make the image after rotation correction in the rectangular shape, spaces with right-angled triangular shapes are added to four corners of the image after rotation when the rotation correction processing of S133 is performed.

If the inclination of the reference sheet SS is different from the inclination of the test sheet TS, the space amount added becomes different. Accordingly, before and after the rotation correction (S133), the position of the line of the measurement pattern with respect to the reference pattern is relatively shifted. Then, the computer 110 prevents deviation of the position of the line of the measurement pattern with respect to the reference pattern by calculating the space amount X by the following expression and subtracting the space amount X from the line position calculated in S136.

$$X=(w\cos\theta-W'/2)\times\tan\theta$$

<Calculation of Line Position in a Scanner Coordinate System (S136)>

Then, the computer 110 calculates the position of the line of the reference pattern and the position of the line of the measurement pattern in the scanner coordinate system (S136).

The scanner coordinate system is a coordinate system when the size of 1 pixel is set to 1/720×1/720 inch. Since there is an error of a read position in the scanner 150, an actual region to which each pixel data corresponds is not 1/720 inch×1/720 inch strictly speaking when the error of the read position is taken into consideration. However, the size of the region (pixel) to which each pixel data corresponds is set to 1/720×1/720 inch in the scanner coordinate system. In addition, a position of an upper left pixel in each image is set to the origin of the scanner coordinate system.

Figure 18A:
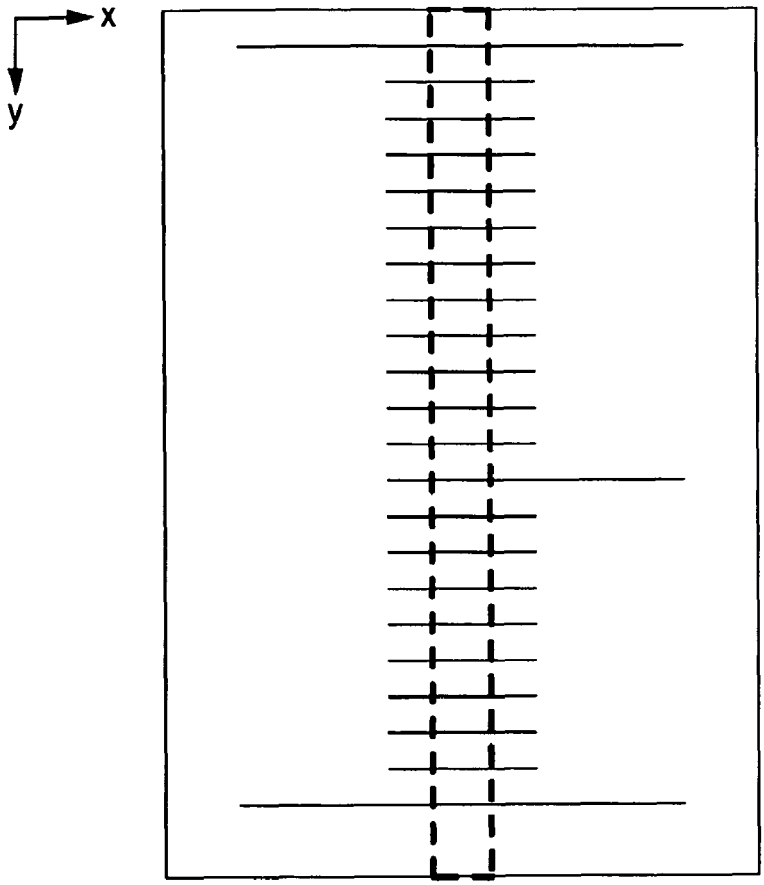
FIG. 18A is an explanatory view of a range of an image used when calculating the position of a line.
Figure 18B:
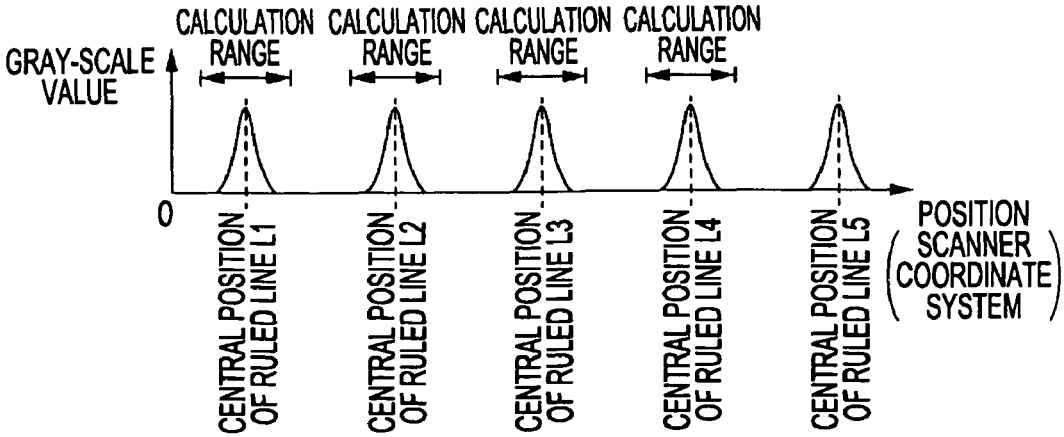
FIG. 18B is an explanatory view of calculation of the position of a line.

FIG. 18A is an explanatory view of a range of an image used when calculating the position of a line. Image data of an image in a range shown by a dotted line in the drawing is used when calculating the position of a line. FIG. 18B is an explanatory view of calculation of the position of a line. The horizontal axis indicates the position (scanner coordinate system) of a pixel in the y direction. The vertical axis indicates a gray-scale value of a pixel (average value of gray-scale values of pixels arrayed in the x direction).

The computer 110 calculates the position of a peak value of a gray-scale value and sets as a calculation range a predetermined range having the position as the center. Then, the central position of the gray-scale value is calculated on the basis of the pixel data of the pixel in the calculation range, and the central position is set to the position of a line.

Figure 19:
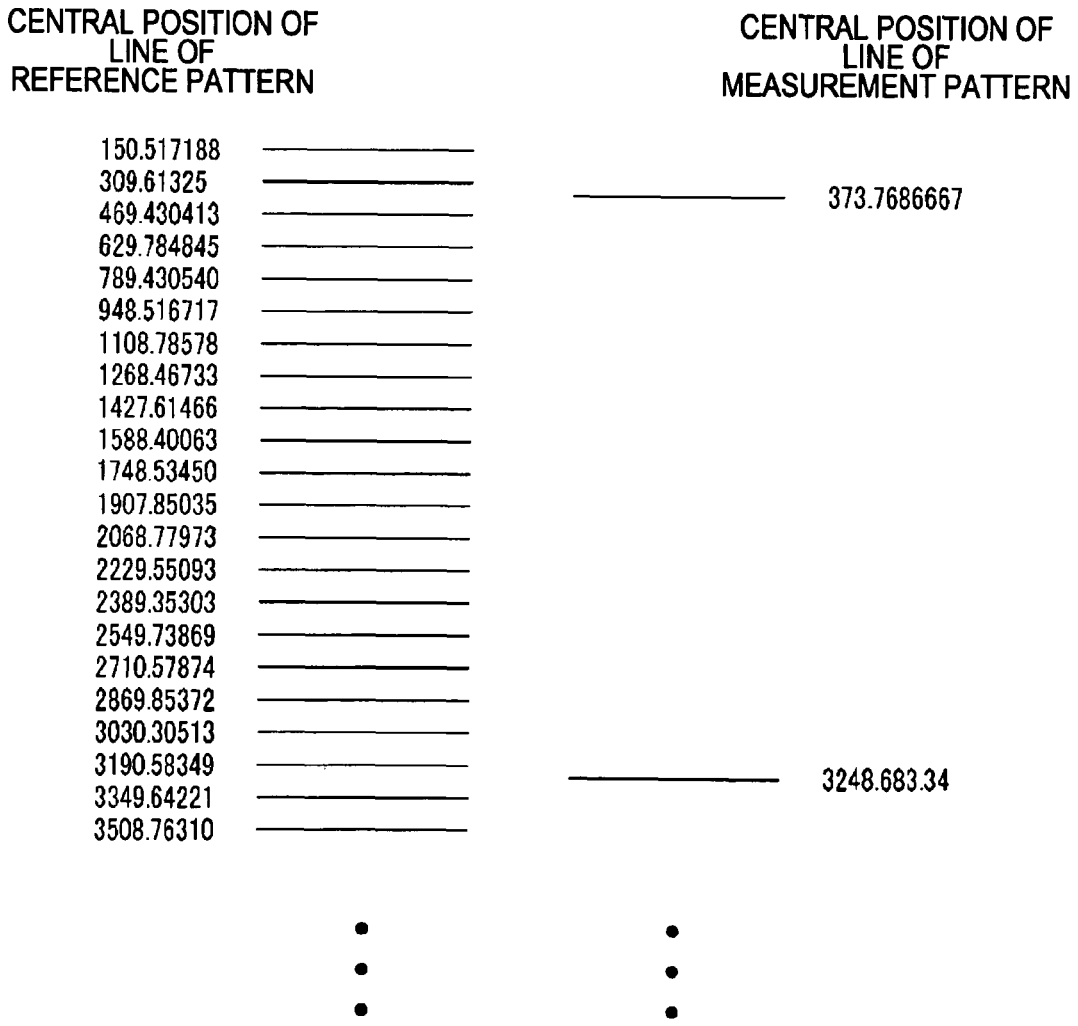
FIG. 19 is an explanatory view of the calculated position of the line.

FIG. 19 is an explanatory view of the calculated position of the line (in addition, the position shown in the drawing has no dimension by a predetermined operation executed). Although the reference pattern is configured to include lines at equal distances, a distance between the positions of the respective lines calculated does not become equal paying attention to the central position of each line of the reference pattern. This is thought due to the influence of an error of the read position of the scanner 150.

<Calculation of an Absolute Position of Each Line of a Measurement Pattern (S137)>

Then, the computer 110 calculates the absolute position of each line of a measurement pattern (S137).

Figure 20:
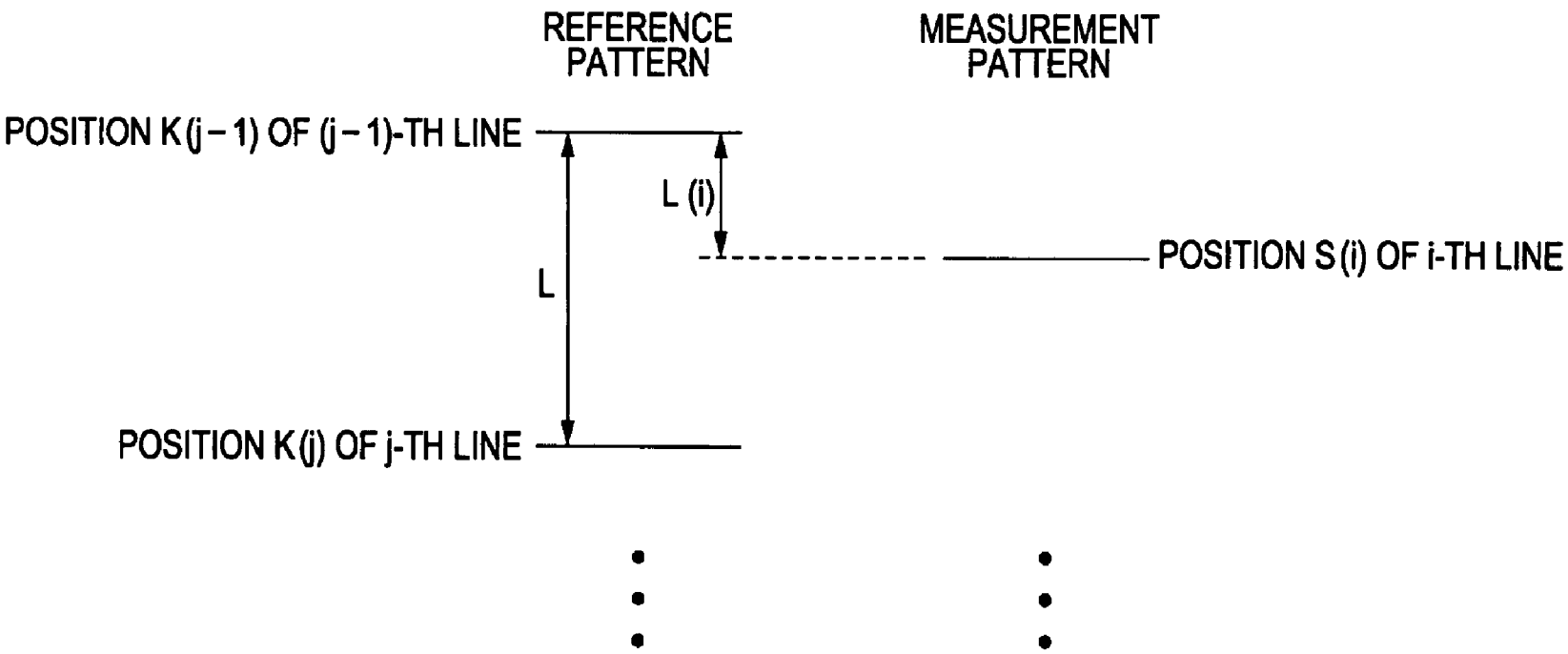
FIG. 20 is an explanatory view of calculation of the absolute position of an i-th line of the measurement pattern.

FIG. 20 is an explanatory view of calculation of the absolute position of an i-th line of the measurement pattern.

Here, the i-th line of the measurement pattern is located between a (j−1)-th line of the reference pattern and a j-th line of the reference pattern. In the following explanation, the position (scanner coordinate system) of the i-th line of the measurement pattern is called 'S(i)' and the position (scanner coordinate system) of the j-th line of the reference pattern is called 'K(j)'. In addition, a space (space in the y direction) between the (j−1)-th line and the j-th line of the reference pattern is called 'L', and a space (space in the y direction) between the (j−1)-th line of the reference pattern and the i-th line of the measurement pattern is called 'L(i)'.

First, the computer 110 calculates a ratio H of the space L(i) to the space L on the basis of the following expression.

$$H=L(i)/L=\{S(i)-K(j-1)\}/\{K(j)-K(j-1)\}$$

By the way, since the reference pattern on the actual reference sheet SS is formed at equal distances, the position of an arbitrary line of the reference pattern can be calculated by setting the absolute position of a first line of the reference pattern to zero. For example, the absolute position of a second line of the reference pattern is 1/36 inch. Therefore, assuming that the absolute position of the j-th line of the reference pattern is 'J(j)' and the absolute position of the i-th line of the measurement pattern is 'R(i)', 'R(i) can be calculated by the following expression.

$$R(i)=\{J(j)-J(j-1)\}\times H+J(j-1)$$

Here, a specific procedure of calculation of the absolute position of the first line of the measurement pattern in FIG. 19 will be described. First, the computer 110 detects that the first line of the measurement pattern is located between the second line and a third line of the reference pattern on the basis of a value (373.768667) of S(1). Then, the computer 110 calculates that the ratio H is 0.40143008 (=(373.7686667−309.613250)/(469.430413−309.613250)). Then, the computer 110 calculates that absolute position R(1) of the first line of the measurement pattern is 0.98878678 mm (=0.038928613 inch={1/36 inch}×0.40143008+1/36 inch).

Thus, the computer 110 calculates the absolute position of each line of the measurement pattern.

<Calculation of a Correction Value (S138)>

Then, the computer 110 calculates correction values corresponding to a plurality of transport operations performed when forming the measurement pattern (S138). Each correction value is calculated on the basis of a difference between a theoretical line space and an actual line space.

A correction value C(i) of a transport operation performed between a path i and a path i+1 is a value obtained by subtracting 'R(i+1)−R(i)' (actual space between the absolute position of the line Li+1 and the line Li) from '6.35 mm' (¼ inch, that is, a theoretical space between the line Li and the line Li+1). For example, a correction value C(1) of the transport operation performed between a path 1 and a path 2 becomes 6.35 mm−{R(2)−R(1)}. The computer 110 calculates the correction value C(1) to correction value C(21) in this way.

Figure 21:
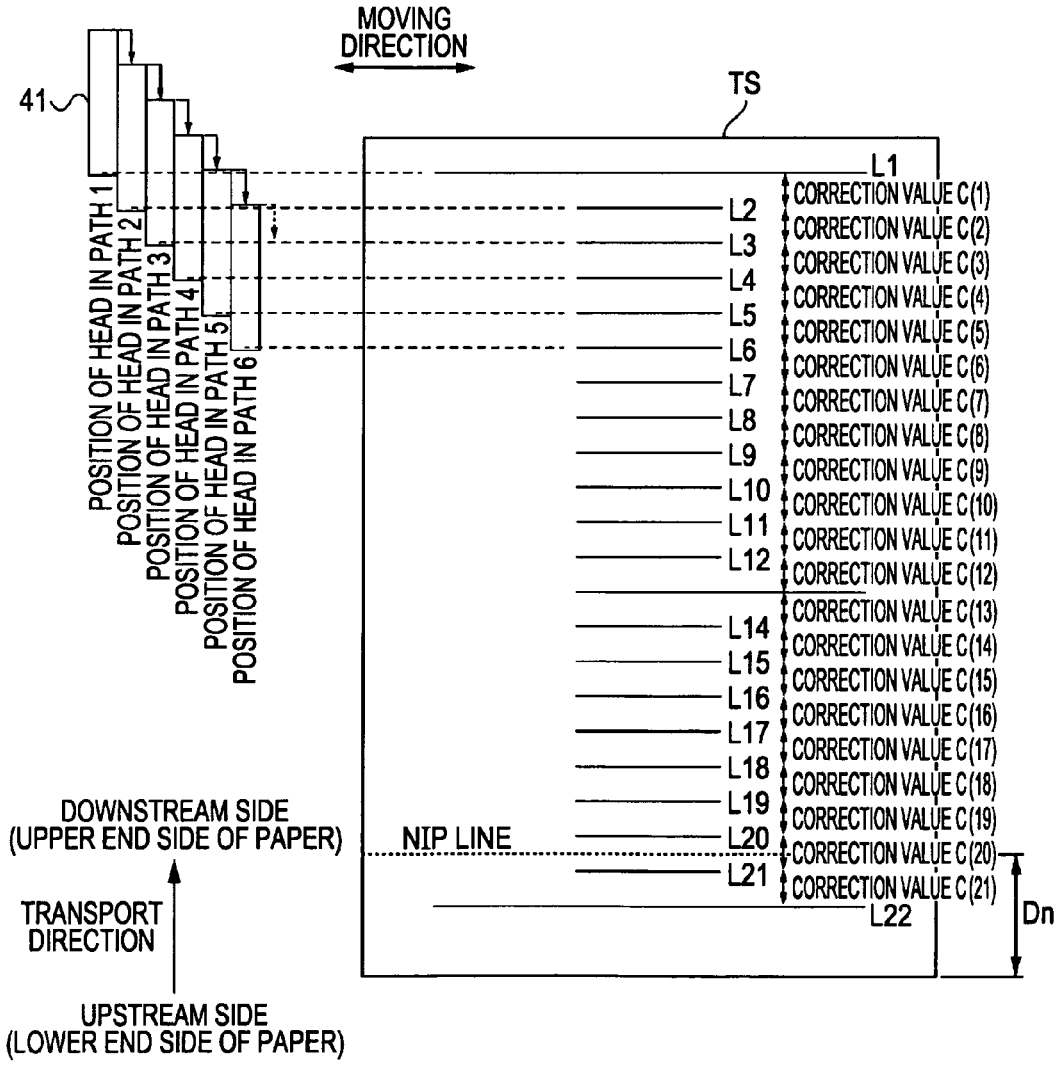
FIG. 21 is an explanatory view of a corresponding range of a correction value C(i).

FIG. 21 is an explanatory view of a corresponding range of the correction value C(i). If a value obtained by subtracting the correction value C(1) from the original target transport amount is targeted at the time of a transport operation between the path 1 and the path 2 when printing the measurement pattern, the actual transport amount should be exactly ¼ inch (=6.35 mm).

<Averaging of a Correction Value (S139)>

By the way, since the rotary encoder 52 of this embodiment includes an origin sensor, the controller 60 can detect the rotation amount of the transport roller 23 but does not detect the rotation position of the transport roller 23. Accordingly, the printer 1 does not guarantee the rotation position of the transport roller 23 at the start of transport. That is, there is a possibility that the rotation position of the transport roller 23 at the start of transport will change whenever printing is performed. On the other hand, a space between two adjacent ruled lines in the measurement pattern is influenced not only by a transport error of a DC component when being transported by ¼ inch but also by a transport error of an AC component.

Accordingly, when the correction value C calculated on the basis of the space between two adjacent ruled lines in the measurement pattern is applied as it is in correcting the target transport amount, there is a possibility that the transport amount will not be corrected correctly due to the influence of the transport error of the AC component. For example, even in the case where a transport operation with the transport amount of ¼ inch is performed between the path 1 and the path 2 in the same manner as when the measurement pattern is printed, if the rotation position of the transport roller 23 at the start of transport is different from that when the measurement pattern is printed, the transport amount is not corrected correctly even if the target transport amount is corrected by the correction value C(1). If the rotation position of the transport roller 23 at the start of transport is different by 180° compared with that when the measurement pattern is printed, the transport amount is not corrected correctly and the transport error may get worse rather due to the influence of the transport error of the AC component.

Therefore, in the present embodiment, in order to correct only a transport error of a DC component, a correction amount Ca for correcting the transport error of the DC component is calculated by averaging four correction values C by the following expression.

$$Ca(i)=\{C(i-1)+C(i)+C(i+1)+C(i+2)\}/4$$

Here, the reason why the correction value Ca for correcting the transport error of the DC component can be calculated by the above expression will be described.

As described above, the correction value C(i) of the transport operation performed between the path i and the path i+1 is a value obtained by subtracting 'R(i+1)−R(i)' (actual space between the absolute position of the line Li+1 and the line Li) from '6.35 mm' (¼ inch, that is, a theoretical space between the line Li and the line Li+1). Then, the upper expression for calculating the correction value Ca has a meaning like the following expression.

$$Ca(i)=[25.4\text{ mm}-\{(i+3)-R(i-1)\}]/4$$

That is, the correction value Ca(i) is a value obtained by dividing a difference between a space of two lines (line Li+3 and line Li−1), which should be distant by 1 inch from each other theoretically, and 1 inch (transport amount corresponding to 1 rotation of the transport roller 23) by 4. In other words, the correction value Ca(i) becomes a value corresponding to a space between the line Li−1 and the line Li+3 formed after transport of 1 inch since the line was formed.

Therefore, the correction value Ca(i) calculated by averaging the four correction values C is not influenced by the transport error of the AC component but becomes a value reflecting the transport error of the DC component.

In addition, a correction value Ca(2) of a transport operation performed between the path 2 and the path 3 is calculated as a value (average value of correction values C(1) to C(4)) obtained by dividing the total sum of the correction values C(1) to C(4) by 4. In other words, the correction value Ca(2) becomes a value corresponding to a space between the line L1 formed in the path 1 and a line L5 formed in a path 5 after transport of 1 inch since the line L1 was formed.

In addition, in case where i−1 becomes zero or less when calculating the correction value Ca(i), C(1) is applied as the correction value C(i−1). For example, the correction value Ca(1) of the transport operation performed between the path 1 and the path 2 is calculated as {C(1)+C(1)+C(2)+C(3)}/4. In addition, in case where i−1 becomes 22 or more when calculating the correction value Ca(i), C(21) is applied as C(i+1) for calculating the correction value Ca. Similarly, when i+2 is 22 or more, C(21) is applied as C(i+2). For example, the correction value Ca(21) of the transport operation performed between the path 21 and the path 22 is calculated as {C(20)+C(21)+C(21)+C(21)}/4.

The computer 110 calculates the correction value Ca(1) to correction value Ca(21) in this way. Then, a correction value for correcting a transport error of a DC component is calculated for every range of ¼ inch.

===Storage of a Correction Value (S104)===

Then, the computer 110 stores a correction value in the memory 63 of the printer 1 (S104).

FIG. 22 is an explanatory view of a table stored in the memory 63. Correction values stored in the memory 63 are the correction values Ca(1) to Ca(21). In addition, boundary position information for indicating a range in which each correction value is applied is related with each correction value and is also stored in the memory 63.

The boundary position information related with the correction value Ca(i) is information indicating the position (theoretical position) corresponding to the line Li+1 of the measurement pattern, and the boundary position information indicates the boundary on the lower end side of a range in which the correction value Ca(i) is applied. In addition, the boundary on the upper end side can be calculated from the boundary position information related with the correction value Ca(i−1). Accordingly, for example, an application range of the correction value C(1) becomes a range between the position of the line L1 and the position of the line L2 (where the nozzle #90 is located) with respect to the paper S.

In a printer factory, a table that reflects a characteristic of each individual printer is stored in the memory 63 for every printer manufactured. Then, the printer in which the table is stored is packed to be shipped.

===Transport Operation when a User Performs Printing===

When a user who purchased the printer performs printing, the controller 60 reads a table from the memory 63, corrects the target transport amount on the basis of a correction value, and performs a transport operation on the basis of the corrected target transport amount. Hereinafter, a situation of the transport operation when the user performs printing will be described.

FIG. 23A is an explanatory view of a correction value in a first case. In the first case, the position (relative position with respect to paper) of the nozzle #90 before the transport operation matches the boundary position on the upper end side of the application range of the correction value Ca(i), and the position of the nozzle #90 after the transport operation matches the boundary position on the lower end side of the application range of the correction value Ca(i). In such a case, the controller 60 transports the paper by driving the transport motor 22 with Ca(i) as a correction value and a value, which is obtained by adding the correction value Ca(i) from an original target transport amount F, as a target.

FIG. 23B is an explanatory view of a correction value in a second case. In the second cases, both positions of the nozzle #90 before and after the transport operation are within the application range of the correction value Ca. In such a case, the controller 60 sets a value, which is obtained by multiplying a ratio F/L of the original target transport amount F and a length L of the application range in the transport direction by Ca(i), as a correction value. Then, the controller 60 transports the paper by driving the transport motor 22 with a value, which is obtained by adding the correction value Ca(i)×(F/L) from the original target transport amount F, as a target.

Figure 23C:
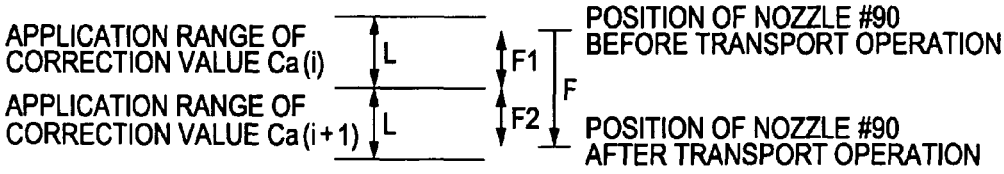
FIG. 23C is an explanatory view of a correction value in a third case.

FIG. 23C is an explanatory view of a correction value in a third case. In the third case, the position of the nozzle #90 before the transport operation is within an application range of the correction value Ca(i), and the position of the nozzle #90 after the transport operation is within an application range of the correction value Ca(i+1). Here, a transport amount within the application range of the correction value Ca(i) of the target transport amount F is set to F1, and a transport amount within the application range of the correction value Ca(i+1) is set to F2. In such a case, the controller 60 sets a sum of a value, which is obtained by multiplying Ca(i) by F1/L, and a value, which is obtained by multiplying Ca(i+1) by F2/L, as a correction value. Then, the controller 60 transports the paper by driving the transport motor 22 with a value, which is obtained by adding the correction value from the original target transport amount F, as a target.

Figure 23D:
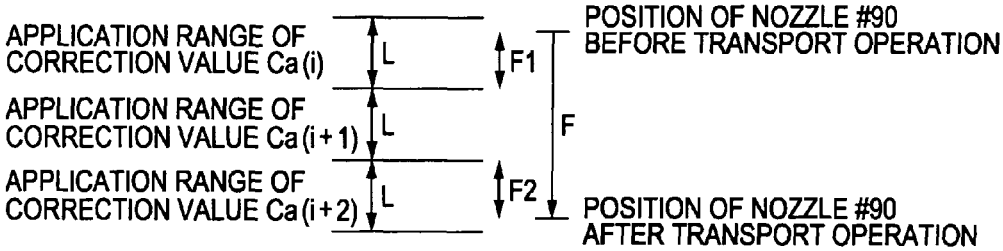
FIG. 23D is an explanatory view of a correction value in a fourth case.

FIG. 23D is an explanatory view of a correction value in a fourth case. In the fourth case, the paper is transported to pass the application range of the correction value Ca(i+1). In such a case, the controller 60 sets as a correction value a sum of a value obtained by multiplying Ca(i) by F1/L, Ca(i+1), and a value obtained by multiplying Ca(i+2) by F2/L. Then, the controller 60 transports the paper by driving the transport motor 22 with a value, which is obtained by adding the correction value from the original target transport amount F, as a target.

Thus, if the controller corrects the original target transport amount F and controls the transport unit on the basis of the target transport amount after correction, the actual transport amount is corrected to become the original target transport amount F and the transport error of the DC component is corrected.

<Importance of a Correction Value at Each Relative Position>

Figure 24A:
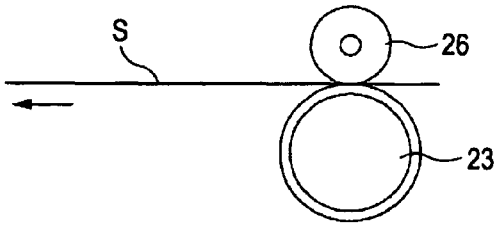
FIG. 24A is a view illustrating a state before paper deviates from a transport roller 23.
Figure 24B:
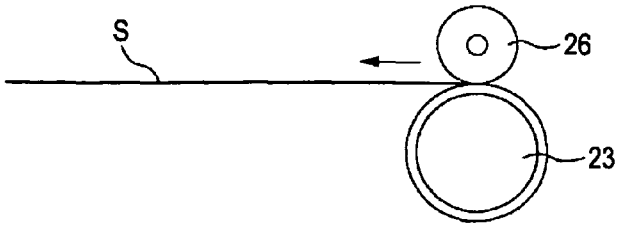
FIG. 24B is a view illustrating a state at the moment when the paper deviates from the transport roller 23.

FIG. 24A is a view illustrating a state before the paper deviates from the transport roller 23, and FIG. 24B is a view illustrating a state at the moment when the paper deviates from the transport roller 23. The driven roller 26 that makes a pair with the transport roller 23 is formed of an elastic body, such as rubber. Accordingly, while the paper S is being transported as shown in FIG. 24A, a force pressed by the elastic force is applied to the paper S placed between the transport roller 23 and the driven roller 26. Since the driven roller 26 is formed of an elastic body as described above, a force to flip the paper S in the transport direction occurs at the moment when the paper S deviates from the transport roller 23 and the driven roller 26 as shown in FIG. 24B. Due to the influence of such a force, it is thought that a transport error when deviating from the transport roller 23 is larger than transport at other positions. Therefore, since it is thought that the importance of a correction value applied when deviating from the transport roller 23 is higher than correction values applied in transport at the other positions, the correction value should be applied in transport exactly when deviating from the transport roller 23.

<Case when the Size of Paper is Different>

Before performing printing on the paper S, setting of the paper size is performed. If the set size of paper match the size of paper on which printing is actually performed, a correction value suitable for transport at each position is applied and highly accurate transport is performed. However, when the actual paper S is shorter in the transport direction than the set size (here, 101.6 mm.times.152.4 mm (4 inches.times.6 inches)) of paper, a correction value may not be applied at the suitable position.

Figure 25:
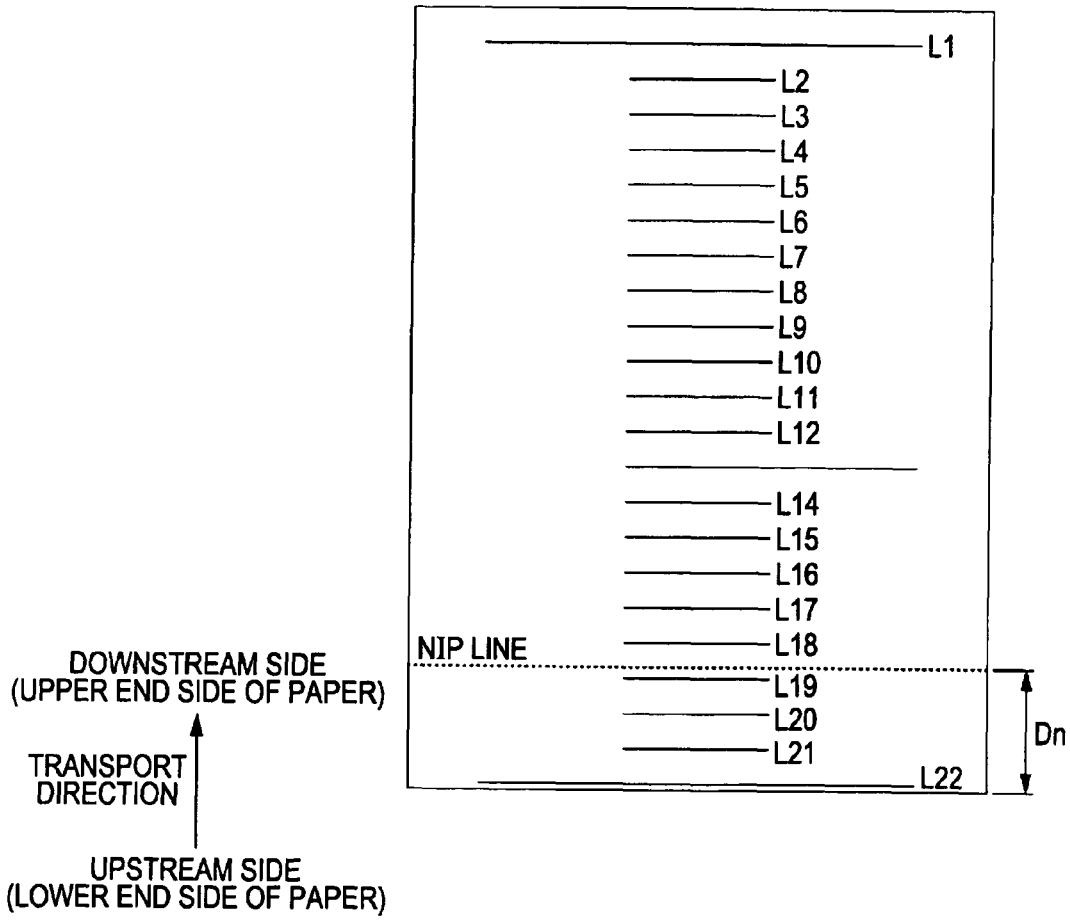
FIG. 25 is a view for explaining the position of a NIP line when the length of the paper in the transport direction is short.

FIG. 25 is a view for explaining the position of a NIP line when the length of paper in the transport direction is short. The size of the paper shown in the drawing is shorter than the set size in the transport direction. Since the NIP line exists at a position of a distance of Dn from the lower end, the NIP line at this time is visited when transport to the boundary position L19 is performed. On the other hand, the NIP line at the time of the paper with the set size (101.6 mm×152.4 mm (4 inches×6 inches)) was visited when the transport to the boundary position L21 was performed.

Accordingly, if a correction value of the set paper size is applied as it is when the size of the paper in the transport direction is short, a correction value that is to be applied when the paper deviates from the transport roller is applied at the time of transport at the other positions. Then, it may be considered that a transport error gets worse on the contrary.

Figure 26:
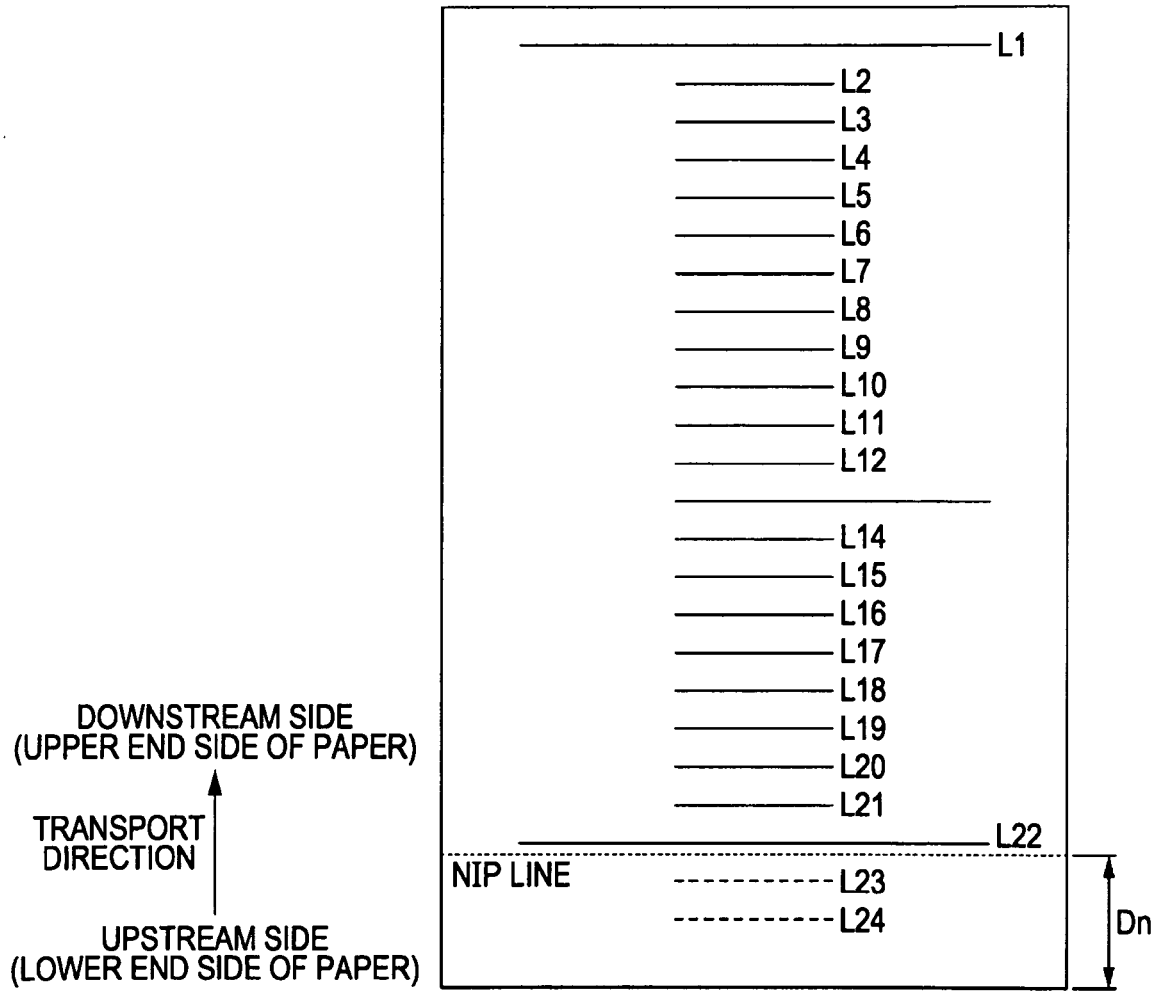
FIG. 26 is a view for explaining the position of a NIP line when the length of the paper in the transport direction is long.

FIG. 26 is a view for explaining the position of the NIP line when the length of paper in the transport direction is long. The size of the paper shown in the drawing is longer than the set size in the transport direction. Since the NIP line exists at a position of a distance of Dn from the lower end, the NIP line at this time is visited after transport to the boundary position L22 ends. Thus, if a correction value of the set paper size is applied as it is when the size of the paper in the transport direction is long, a correction value that is to be applied when the paper deviates from the transport roller is applied at the time of transport at the other positions. Then, it may be considered that a transport error gets worse on the contrary.

<Regarding a Correction Value of the Lower End of Paper>

Figure 27A:
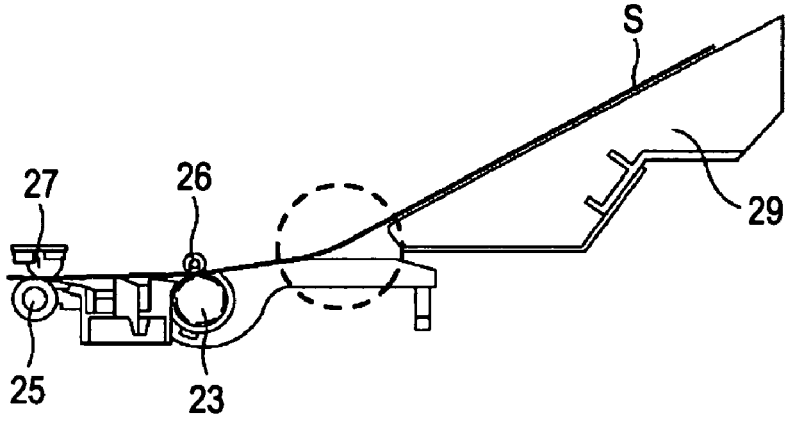
FIG. 27A is a view illustrating the position of paper in an initial stage when the paper is transported by the transport roller 23 and a paper discharge roller 25.
Figure 27B:
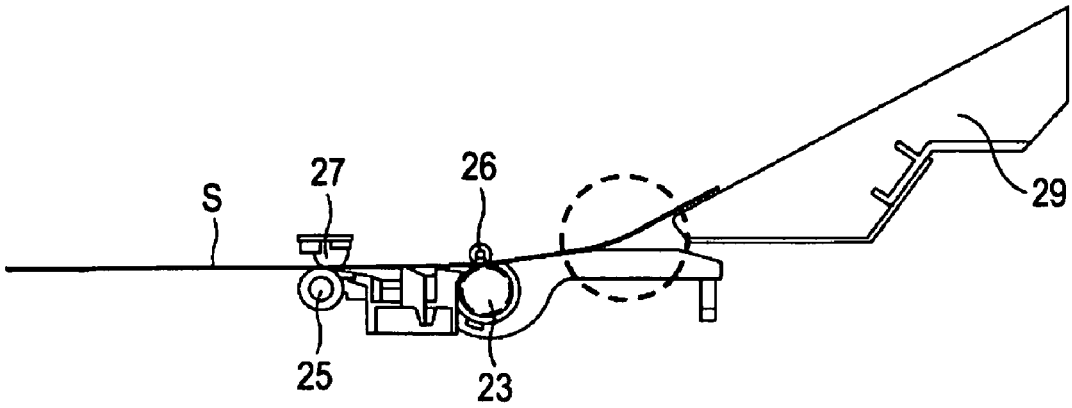
FIG. 27B is a view illustrating the position of the paper in a later stage when the paper is transported by the transport roller 23 and the paper discharge roller 25.

FIG. 27A is a view illustrating the position of paper in an initial stage when the paper is transported by the transport roller 23 and the paper discharge roller 25. In the initial stage, the neighborhood of the upper end of the paper (neighborhood of a downstream side of the paper) is interposed between the transport roller 23 and the paper discharge roller 25. In addition, most of the rear end of the paper is in contact with a paper feed base 29. FIG. 27B is a view illustrating the position of the paper in a later stage when the paper is transported by the transport roller 23 and the paper discharge roller 25. In the later stage, a portion being in contact with the paper feed base 29 near the rear end of the paper (near an upstream side of the paper) is small.

Referring to FIG. 27A, there is a place where the paper is bent between the paper feed base 29 and the transport roller 23 (place surrounded by a dotted line in the drawing). It is thought that the bending amount of the paper has almost the same bending amount until going into the later stage from the initial stage of paper transport. On the other hand, referring to FIG. 27B, in the later stage, most of the paper on the upstream side is not in contact with the paper feed base 29, and the bending amount of the place surrounded by the dotted line in the drawing changes largely as the paper is transported.

The change in the bending amount of the paper affects a change in transport error. Accordingly, before going into the later stage of paper transport, a transport error occurs but the amount of fluctuation of the transport error is small. The relative position of the paper in a middle stage from the initial stage in which a change in the bending amount of the paper is small is when a middle portion is near the head from a portion of a downstream side (upper end side) of the paper. Therefore, it is thought that the amount of fluctuation of a transport error when the middle portion from the upper end side of the paper is small compared with the amount of fluctuation of a transport error when the portion of the downstream side of the paper is near the head. A correction value becomes an amount corresponding to the amount of a transport error. Accordingly, when the amount of fluctuation in a transport error is small, transport errors of adjacent positions become relatively close amounts and adjacent correction values also become relatively close values.

In case where the size of paper is made small, it may be thought that a point of time when the amount of fluctuation of a transport error is small, that is, transport of a portion where a change in bending amount is relatively small is omitted. Therefore, in case of creating a table of correction values of paper with a smaller size from a table of correction values of the paper with the set size, it is desirable to create a table of correction values of small size by deleting a correction value corresponding to the portion where the change in the bending amount is small.

On the other hand, in case of creating a table of correction values of a larger size from the table of the paper with the set size, it is desirable to use a correction value of a portion where the change in the bending amount is relatively small more than once and to perform creation to interpolate an insufficient correction value. This is because it may be considered that transport of the portion where the change in the bending amount is small was added in the case where the size of the paper to be transported is made large.

From these things, in the case where the size of the paper is different from the set size, it is desirable to apply a corresponding correction value with a distance from the lower end as a reference for transport of the neighborhood of a lower end portion where the amount of fluctuation in the transport error is large. In addition, by applying a corresponding correction value with the distance from the lower end as a reference, a correction value that is to be applied when the paper deviates from the transport roller can be reliably applied to a position when the paper deviates even if the size of the paper is different.

In an embodiment shown below, by detecting the lower end portion of the paper and then applying a correction value corresponding to the relative distance from the lower end, a correction value that is to be applied to the neighborhood of the lower end portion can be reliably applied to the neighborhood of the lower end portion even when the size of the paper is different from the set size.

===Embodiment===

Figure 28A:
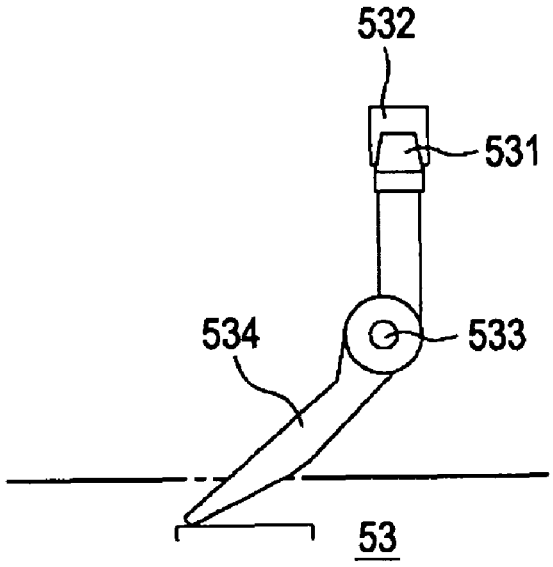
FIGS. 28A and 28B are views for explaining an operation of a paper detecting sensor 53.
Figure 28B:
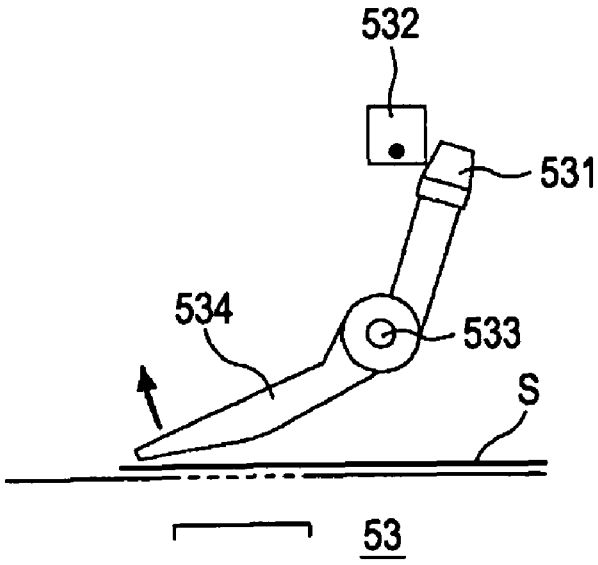

FIGS. 28A and 28B are views for explaining an operation of the paper detecting sensor 53. As described above, the paper detecting sensor 53 is fixed at a more upstream side than the transport roller 23, which is a roller at the upstream side, so as to detect the upper and rear ends of the paper. The paper detecting sensor 53 includes a paper contact member 534, which comes in contact with the paper, and an optical path cutoff member 531. The paper contact member 534 and the optical path cutoff member 531 are molded integrally and are fixed in the printer 1 so as to be rotatable around a shaft 533 as a supporting point. In addition, the paper detecting sensor 53 also includes an optical sensor 532.

When the paper S is not in contact with the paper contact member 534, these positions become positions shown in FIG. 28A by the weight of the paper contact member 534 and the optical path cutoff member 531. On the other hand, when the paper S comes in contact with the paper contact member 534, the paper contact member moves clockwise with the shaft 533 as a supporting point, and the optical path cutoff member 531 molded integrally also moves clockwise with the shaft 533 as a supporting point (FIG. 28B).

In the drawing, a laser emitting device (not shown) for irradiating light to the optical sensor 532 is fixed in a front side of the paper. When the paper S is not in contact with the paper contact member 534, the sensor 532 does not detect a laser beam because the optical path cutoff member 531 cuts a laser beam from a laser emitting device. On the other hand, when the paper S comes in contact with the paper contact member 534 to thereby move clockwise, the optical path cutoff member 531 also rotates clockwise and the optical path cutoff member 531 that cut the laser beam moves so that the optical sensor 532 detects light.

If transport of the paper S proceeds to end the contact between the paper contact member 534 and the lower end of the paper S, the positions of the paper contact member 534 and the optical path cutoff member 531 return to the positions shown in FIG. 28A again. An output of the optical sensor 532 is connected to the controller 60. Then, the controller 60 can detect whether or not the paper S is in contact with the paper contact member 534 on the basis of whether or not the optical sensor 532 is receiving a laser beam. In this way, the upper and lower ends of the paper can be detected.

In addition, the paper detecting sensor 53 and the controller 60 correspond to sensors for detecting the lower end of the paper. In addition, other sensors may also be used if the lower end of the paper can be detected.

FIG. 29 is a view for explaining a table of correction values used in the present embodiment. In the drawing, correction values used when transporting the paper S of 101.6 mm×152.4 mm (4 inches×6 inches) are shown together with corresponding boundary position information.

The table of correction values is prepared for every size of the paper. When performing printing on the paper, the size of the paper to be printed is set through the computer 110. Accordingly, a correction value that matches the size of the paper is applied and transport is performed. Also in the case of the present embodiment, since information that printing using the paper of 4 inches×6 inches is performed is transmitted beforehand from the computer 110 to the controller 60 of the printer 1, the controller 60 reads the table of correction values shown in the drawing from the memory 63 and uses it.

Moreover, in the following explanation, an explanation is made assuming that a 'transport range up to Li' indicates a 'transport range from a theoretical position corresponding Li−1 to a theoretical position corresponding to Li.

In the printer 1 of the present embodiment, the lower end of the paper S is detected in the transport range up to L16, from the relationship of the position at which the paper detecting sensor 53 is provided. In addition, it is shown that correction values corresponding to a transport range with the lower end as a reference are Ca(16) to Ca(21). In addition, it is shown that transport when the paper deviates from the transport roller is in a transport range up to L21. In addition, it is shown that a correction value corresponding to a theoretical position equivalent to L21 is Ca(20).

Figure 30:
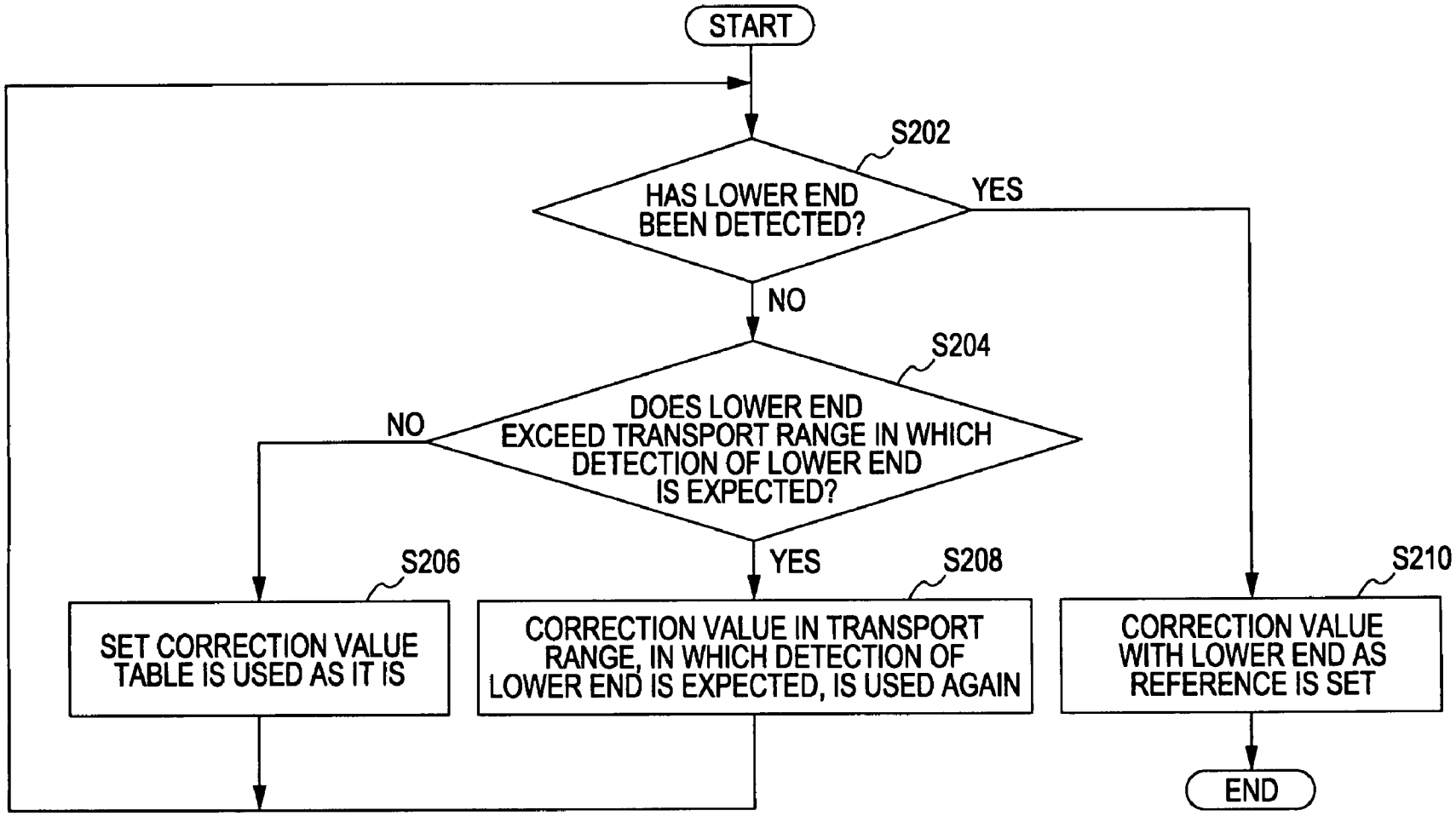
FIG. 30 is a flow chart for explaining the present embodiment.

FIG. 30 is a flow chart for explaining the present embodiment. First, the controller 60 determines whether or not the lower end of the paper S was already detected (S202). When the lower end of a paper is not detected, the controller 60 determines whether or not a transport range (here, a transport range up to L16), in which the lower end of the paper is to be detected, is exceeded (S204). When the transport range in which the lower end of the paper S is to be detected is not exceeded, the set table (FIG. 29) of correction values is used as it is, the transport amount is corrected on the basis of corresponding boundary information (S206), and the paper is transported. Then, step S202 is executed again. By repeating such an operation, the paper S is transported while a correction value corresponding to boundary position information with the upper end of the paper S as a reference is being applied.

If such transport continues when the length of the paper in the transport direction is short, the lower end of the paper is detected before reaching the transport range in which the lower end is to be detected (S202). If the lower end of the paper S is detected, the table of correction values is rewritten such that a correction value is applied with the lower end as a reference from a correction value of the current transport range corresponding to the next transport range (S210). Then, transport is performed while correcting the transport amount on the basis of the rewritten table of correction values. For example, when the lower end of the paper is detected while transport of the transport range up to L14 is being performed, the table of correction values is rewritten such that correction values corresponding to boundary position information L15 and subsequent ones after the boundary position information L14 are applied as correction values with the lower end as a reference.

FIG. 31 is an example of the order of correction values applied when the size of paper in the transport direction is short. Here, since the lower end of the paper was detected while the transport of the transport range up to L14 is being performed, correction values corresponding to the next boundary position information L15 to L20 are rewritten to correction values Ca(16) to Ca(21) with the lower end as a reference. Thus, since the correction values with the lower end as a reference are applied after detecting the lower end of the paper, correction values that are to be applied to the neighborhood of the lower end portion can be reliably applied to the neighborhood of the lower end portion.

By the way, when the transport range in which the lower end is to be detected is exceeded in step 204, the controller 60 matches a correction value, which was matched with the transport range in which the lower end is to be detected, to be used again in the next transport range (S208). This indicates that when the lower end of the paper S is not detected in step S202 and the transport range in which the lower end is to be detected is exceeded in step S204, the lower end is not yet visited although the lower end should already have been detected originally. This indicates that the length of the paper S in the transport direction is longer than the set length of paper.

In such a case, a correction value that may be insufficient is supplemented by applying a correction value corresponding to the range in which the lower end is to be detected again. In the present embodiment, the transport range in which the lower end is to be detected is the transport range up to L16, and the correction value corresponding thereto is Ca(15). Accordingly, Ca(15) is used again in this case.

FIG. 32 is an example of the order of correction values applied when the size of paper in the transport direction is large. Since the length of the paper in the transport direction is long, it is shown that the correction value Ca(15) is repeatedly used more than twice.

When the correction value of the range in which the lower end is to be detected is repeatedly used to perform transport, the lower end of the paper S is detected (S202). If the lower end of the paper S is detected, the controller 60 executes step S210 to rewrite a table of correction values such that a correction value with the lower end as a reference is applied from a correction value of the current transport range corresponding to the next transport range. Here, since the lower end of the paper was detected in the transport range up to L18, it is shown that correction values corresponding to the next boundary information L19 to L24 are rewritten to correction values Ca(16) to Ca(21) with the lower end as a reference (FIG. 32).

In this way, in a case where the size of the paper in the transport direction is small or large, transport of the neighborhood of a lower end portion can be performed using the correction value with the lower end as a reference. In addition, the transport of the neighborhood of the lower end portion where transport tends to be unstable can be transported by applying a suitable correction value. In particular, even if the size of the paper is different, a correction value that is to be applied when the paper deviates from the transport roller 23 can be reliably applied to the position when the paper deviates.

In the present embodiment, the case where the paper smaller or larger than the size of the paper on which printing is expected is used has been described. However, the application may also be made in the case when the relative position of a correction value to be used has deviated due to a certain cause even though a medium with the same size as the set medium size was used. The above-described embodiment may also be applied, for example, when the relative position of a correction value to be applied has deviated due to a size change caused by the individual difference, such as a manufacture error of a medium, and a slight change in the size of a medium caused by the environment. This is because the position of a correction value to be applied is modified while detecting the lower end by the paper detecting sensor 53. In addition, the transport of the neighborhood of the lower end portion where transport tends to be unstable can be transported by applying a suitable correction value.

===Other Embodiments===

Although the above embodiment mainly describes the printer, it is needless to say that disclosure of a printing apparatus, a recording apparatus, a discharge apparatus of liquid, a transport method, a printing method, a recording method, a discharge method of liquid, a printing system, a recording system, a computer system, a program, a storage medium recorded with a program, a display screen, a screen display method, a manufacturing method of a printed matter, and the like is included therein.

In addition, although the printer as an embodiment was described, the above embodiment is to make the present invention easily understood and is not interpreted to limit the present invention. The present invention may be changed and modified without departing from the object, and it is needless to say that the equivalents are included in the present invention. Particularly embodiments described below are also included in the present invention.

<Regarding a Printer>

In the above embodiment, the printer was described, but it is not limited thereto. For example, the same technique as the present embodiment may also be applied to various recording apparatuses applying the ink jet technique, such as a color filter manufacturing apparatus, a dyeing apparatus, a micromachining apparatus, a semiconductor manufacturing apparatus, a surface treatment apparatus, a three-dimensional modeling device, a liquid vaporizer, an organic EL manufacturing apparatus (particularly a polymer EL manufacturing apparatus), a display manufacturing apparatus, a film forming apparatus, and a DNA chip manufacturing apparatus.

In addition, the application may also be made to a thermal printer, for example, without being limited to using the piezoelectric element. In addition, the application may also be made to a wire dot printer and the like without being limited to one that discharges liquid.

The invention claimed is:

1. A recording apparatus comprising:

a head for performing recording on a medium, a transport mechanism that includes a roller on an upstream side of the head and transports the medium in the transport direction according to a target transport amount that is targeted, a memory that stores a plurality of correction values which are correction values for correcting the target transport amount when transporting the medium and which are matched with a relative position of the head and the medium, a sensor that is provided at a more upstream side than the upstream-side roller in order to detect a lower end of the medium transported in the transport direction, and a controller that corrects the target transport amount by a first correction value, which is matched with the relative position with an upper end of the medium as a reference, and controls the transport mechanism to transport the medium by the corrected target transport amount and that corrects the target transport amount by a second correction value, which is matched with the relative position with the lower end of the medium as a reference, after detecting the lower end of the medium by the sensor and controls the transport mechanism to transport the medium by the corrected target transport amount, wherein the transport mechanism further includes a roller on a downstream side of the head in order to transport the medium in the transport direction, and when the lower end of the medium is not detected even if transport up to the relative position at which the lower end of the medium is to be detected is performed, the controller controls the transport mechanism to transport the medium while correcting the target transport amount such that some of correction values used when transport by both the roller provided on the upstream side and the roller on the downstream side is performed are used multiple times.

2. The recording apparatus according to claim 1, wherein when the lower end of the medium is detected before transport up to the relative position at which the lower end of the medium is to be detected is performed, the controller controls the transport mechanism to transport the medium while correcting the target transport amount such that some of correction values used when transport by both the roller provided on the upstream side and the roller on the downstream side is performed are not used.

3. The recording apparatus according to any one of claims 1 and 2, wherein each of the correction values is matched with a range of the relative position to which the correction value is to be applied, and the controller corrects the target transport amount by giving weight to the correction value according to a ratio of a range, in which the relative position at the time of transport with the target transport amount changes, and the range of the relative position at which the correction value is to be applied.

4. A transport amount correcting method comprising:

storing a plurality of correction values which are correction values for correcting a target transport amount when transporting a medium and which are matched with a relative position of a head and the medium;

correcting the target transport amount by a first correction value, which is matched with the relative position with an upper end of the medium as a reference, and transporting the medium by the corrected target transport amount;

correcting the target transport amount by a second correction value, which is matched with the relative position with a lower end of the medium as a reference, after a sensor provided at a more upstream side than an upstream-side roller detects the lower end of the medium transported in the transport direction and transporting the medium by the corrected target transport amount; and when the lower end of the medium is not detected even if transport up to the relative position at which the lower end of the medium is to be detected is performed, transporting the medium while correcting the target transport amount such that some of correction values used when transport by both the upstream-side roller and a downstream-side roller is performed are used multiple times.

* * * * *